US010508878B1

(12) United States Patent
Oglesby

(10) Patent No.: US 10,508,878 B1
(45) Date of Patent: Dec. 17, 2019

(54) BLAST SHIELD ATTACHMENT SYSTEM

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 15/900,538

(22) Filed: Feb. 20, 2018

Related U.S. Application Data

(60) Provisional application No. 62/462,331, filed on Feb. 22, 2017.

(51) Int. Cl.
*F41A 21/34* (2006.01)
*F41A 21/32* (2006.01)
*F41A 21/36* (2006.01)

(52) U.S. Cl.
CPC ..... *F41A 21/325* (2013.01); *F41A 21/34* (2013.01); *F41A 21/36* (2013.01)

(58) Field of Classification Search
CPC ..... F41A 21/32; F41A 21/325; F41A 21/36; F41A 21/34
See application file for complete search history.

(56) References Cited

U.S. PATENT DOCUMENTS 1,555,026 A 9/1925 Rose
2,900,875 A 8/1959 Fergus
3,202,056 A * 8/1965 Seeberger ..... F41A 21/325 89/14.3
4,510,843 A * 4/1985 Rabatin ..... F41A 21/325 89/14.4
5,433,133 A 7/1995 La France
5,596,161 A * 1/1997 Sommers ..... F41A 21/34 89/14.2
5,773,746 A * 6/1998 Vaden ..... F41A 21/325 181/223
6,752,062 B2 6/2004 Vais
6,837,139 B2 1/2005 Meyers
2003/0106416 A1 6/2003 Vias

FOREIGN PATENT DOCUMENTS

WO WO-2008141736 A1 * 11/2008 ..... F41A 21/325
WO WO-2016150973 A1 * 9/2016 ..... F41A 21/36

* cited by examiner

*Primary Examiner* — Stephen Johnson
(74) *Attorney, Agent, or Firm* — Shaddock Law Group, PC

(57) ABSTRACT

A blast shield attachment system that includes a collar having one or more locking notches formed at least partially therethrough and one or more engagement pins extending therefrom; and a blast shield having a collar receiving recess, wherein one or more engagement grooves extend from a first end of the blast shield, wherein one or more levers are pivotably attached or coupled to the blast shield, wherein each lever is pivotable for releasable engagement with a corresponding one of the locking notches of the collar, and wherein when at least a portion of the collar is appropriately received within the collar receiving recess, at least one of the one or more engagement pins is aligned within at least one of the one or more engagement grooves and each lever is releasably engaged with a corresponding one of the locking notches of the collar.

20 Claims, 29 Drawing Sheets

BLAST SHIELD ATTACHMENT SYSTEM

CROSS-REFERENCE TO RELATED APPLICATIONS

This patent application claims the benefit of U.S. Patent Application Ser. No. 62/462,331, filed Feb. 22, 2017, the disclosure of which is incorporated herein by reference in its entirety.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, the applicant owns all trademarks and service marks identified herein.

BACKGROUND OF THE PRESENT DISCLOSURE

1. Field of the Present Disclosure

The present disclosure relates generally to the field of firearms. More specifically, the present disclosure relates to blast shield attachment systems for firearms.

2. Description of Related Art

A muzzle brake is a device that is attached to the second end of a firearm muzzle, which redirects propellant gases to counter recoil and unwanted barrel rise that normally occurs during the firing sequence.

During normal operation of a firearm, and particularly a rifle, when a round is fired, expanding gasses from the burning propellant forces the bullet through the barrel. As the bullet travels down and out of the barrel, the bullet and the propellant gases act on barrel, along the longitudinal axis, or centerline, of the barrel, to produce a recoil force. Because of the difference between the longitudinal axis of the barrel and the average point of contact between the firearm and the user (the average point where the user resists the recoil force), the muzzle end of the firearm's barrel rotates upward.

Muzzle brakes typically utilize one or more slots, vents, holes, and/or baffles to divert and/or redirect the propellant gases as they leave the barrel.

A flash suppressor, flash guard, flash eliminator, or flash hider is a device that is attached to the second end of a muzzle of a firearm that reduces the visible flash signature of the firearm, when it is fired, by dispersing or cooling the burning propellant gases, as they exit the muzzle of the firearm. The flash suppressor reduces the chances that the individual shooting the firearm will be temporarily blinded in lowlight shooting conditions and/or reduce the degree of muzzle flash visible to others.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

The typical flash suppressor geometry and arrangement has various shortcomings. For example, known flash suppressors do not allow for sufficient propellant gas to be cooled or disbursed prior to exiting the muzzle end of the firearm. Because of this, known flash suppressors do not produce an effective amount of muzzle flash reduction.

Thus, the features and elements of the presently disclosed blast mitigation devices provide various flash suppressor features and design elements that overcome the shortcomings of known flash suppressors and other blast mitigation devices and provide improved, blast mitigation.

In various exemplary, nonlimiting embodiments, the presently disclosed blast mitigation devices mount (via a blast shield attachment system or mounting system that may optionally be integral to the muzzle device) to a muzzle device, mainly a muzzle brake/flash hider, that diverts propellant gas forwards, away from a shooter, reducing side blast and concussion.

In various exemplary, nonlimiting embodiments, the presently disclosed blast mitigation devices mount to the device via a series of quick attach/detach levers that register with cuts or notches on an adapter collar. The levers are spring biased and each lever is required to be depressed in order for the blast mitigation device to be removed from the muzzle device or collar.

One or more alignment, registration, or engagement pins extend from the collar and interact with one or more alignment, registration, or engagement grooves formed in the blast shield or blast mitigation device.

The blast mitigation device also utilizes a series of small holes or blast shield venting apertures to diffuse propellant gas. In various exemplary embodiments, the blast shield venting apertures are placed in a radial fashion around the diameter of the blast shield. In certain exemplary embodiments, the holes or apertures in the blast shield are position only in the top 180 degrees of the blast shield and mainly in the top 90 degrees of the blast shield. The positioning of these blast shield venting apertures at these locations assists in muzzle rise mitigation by allowing propellant gas to escape upwards and outwards but not downwards, thus pushing the muzzle down at the time of firing.

The blast shield also utilizes angled "through" holes or primary blast shield venting apertures that connect to special ports or venting apertures on the top of the muzzle brake. This allows vertical ported propellant gas to exit the blast mitigation device and assist in pushing the muzzle down at time of firing. Known flash suppressors do not have through porting and therefore muzzle devices placed inside these systems are defeated as they cannot work properly due to being contained within an object.

In certain exemplary embodiments, the blast shield also features radial teeth like protrusions at the mouth of the blast shield that assist in mixing escaping propellant gas with surrounding air.

The present disclosure is directed to a blast mitigation device comprising a collar having a central collar aperture formed therethrough and having one or more collar venting apertures and one or more locking notches; and a blast shield having one or more levers, one or more blast shield venting apertures, and a collar receiving recess, wherein each lever is pivotable for releasable engagement with a corresponding locking notch and wherein when at least a portion of the collar is appropriately received within the collar receiving recess, each collar venting aperture is aligned with each blast shield venting aperture.

The present disclosure is also directed to a blast mitigation device comprising at least some of a collar having a central collar aperture formed therethrough and having one or more collar venting apertures and one or more locking notches; a blast shield having one or more levers, one or more blast shield venting apertures, and a collar receiving recess, wherein each lever is pivotable for releasable engagement with a corresponding locking notch and wherein when at least a portion of the collar is appropriately received within the collar receiving recess, each collar venting aperture is aligned with each blast shield venting aperture; and a muzzle brake having one or more muzzle brake venting apertures, wherein the muzzle brake may be releasably secured within at least a portion of the central collar aperture, the at least one muzzle brake venting aperture is aligned with the at least one collar venting aperture and the at least one blast shield venting aperture.

The present disclosure is also directed to a blast mitigation device comprising at least some of a collar, wherein the collar includes a central collar aperture, wherein the central collar aperture is formed so as to allow at least a portion of a muzzle device to be at least partially positioned within the central collar aperture, wherein the collar includes one or more locking notches formed in at least a portion of the collar body; and a blast shield, wherein the blast shield includes a collar receiving recess, wherein the blast shield includes one or more levers pivotally attached or coupled to the blast shield, wherein each lever is pivotable between an engaged position and a disengaged position, and wherein the collar receiving recess is adapted to receive at least a portion of the collar within the collar receiving recess so as to allow the levers to engage the locking notches and secure the blast shield to the collar.

The present disclosure is also directed to a blast mitigation device that includes a collar having a central collar aperture formed therethrough, wherein the collar includes one or more collar venting apertures, one or more locking notches, and one or more engagement pins; and a blast shield having one or more levers, one or more blast shield venting apertures, a collar receiving recess, and one or more engagement grooves, wherein each lever is pivotable for releasable engagement with a corresponding locking notch and wherein when at least a portion of the collar is appropriately received within the collar receiving recess, at least one of the one or more engagement pins is aligned within at least one of the one or more engagement grooves and each collar venting aperture is aligned with each blast shield venting aperture.

Thus, the features and elements of the presently disclosed blast mitigation devices provide various blast mitigation features and design elements that overcome the shortcomings of known blast mitigation devices and provide improved, blast mitigation.

In various exemplary, nonlimiting embodiments, the blast shield attachment system of the present disclosure includes at least some of a collar having one or more locking notches formed at least partially therethrough and one or more engagement pins extending therefrom; and a blast shield having a collar receiving recess, wherein one or more engagement grooves extend from a first end of the blast shield, wherein one or more levers are pivotably attached or coupled to the blast shield, wherein each lever is pivotable for releasable engagement with a corresponding one of the locking notches of the collar, and wherein when at least a portion of said collar is appropriately received within said collar receiving recess, at least one of said one or more engagement pins is aligned within at least one of said one or more engagement grooves and each lever is releasably engaged with a corresponding one of the locking notches of the collar.

In various exemplary, nonlimiting embodiments, said one or more locking notches are formed through a collar body of the collar.

In various exemplary, nonlimiting embodiments, said collar includes a central collar aperture formed therethrough.

In various exemplary, nonlimiting embodiments, each of said engagement grooves comprises a substantially "L" shaped engagement groove.

In various exemplary, nonlimiting embodiments, said collar further comprises one or more interior flats extending into at least a portion of said central collar aperture. Each of said one or more interior flats may optionally be formed so as to engage a flat portion formed in an exterior surface of a muzzle device.

In various exemplary, nonlimiting embodiments, a muzzle device is at least partially received within the central collar aperture. The muzzle device may optionally attach or couple the collar to a firearm barrel.

In various exemplary, nonlimiting embodiments, the collar includes one or more collar venting apertures and the blast shield includes one or more blast shield venting apertures, such that when the collar is attached or coupled to the blast shield, each engagement pin is positioned proximate an engagement stop of each of said one or more engagement grooves, and each lever is releasably engaged with a corresponding one of the locking notches of the collar, each collar venting aperture is aligned with a corresponding blast shield venting aperture.

In various exemplary, nonlimiting embodiments, each engagement pin extends radially from the collar.

In various exemplary, nonlimiting embodiments, the blast shield attachment system of the present disclosure includes at least some of a collar having one or more locking notches formed at least partially therethrough and one or more engagement pins extending therefrom; and a blast shield having a collar receiving recess, wherein one or more substantially "L" shaped engagement grooves extend from a first end of the blast shield to an engagement stop, wherein one or more levers are pivotably attached or coupled to the blast shield, wherein each lever is pivotable for releasable engagement with a corresponding one of the locking notches of the collar, and wherein when at least a portion of said collar is appropriately received within said collar receiving recess and each engagement pin is positioned proximate the engagement stop of each of said one or more engagement grooves, each lever is releasably engaged with a corresponding one of the locking notches of the collar.

In various exemplary, nonlimiting embodiments, the blast shield attachment system of the present disclosure includes at least some of a collar having one or more locking notches formed at least partially therethrough and one or more engagement pins extending therefrom; and a blast shield having a collar receiving recess, wherein one or more substantially "L" shaped engagement grooves extend from a first end of the blast shield to an engagement stop, wherein one or more levers are pivotably attached or coupled to the blast shield, such that each lever is pivotable for releasable engagement with a corresponding one of the locking notches of the collar, and wherein when at least a portion of said collar is appropriately received within said collar receiving recess and each engagement pin is positioned proximate the engagement stop of each of said one or more engagement grooves, each lever is releasably engaged with a corresponding one of the locking notches of the collar.

Accordingly, the present disclosure provides a blast mitigation device with improved muzzle flash suppression.

The present disclosure separately provides a blast mitigation device and/or blast shield that may be utilized in conjunction with a flash suppressor or other muzzle device that provides improved cooling, burning, and/or disbursement of propelling gases exiting the muzzle end of a firearm.

The present disclosure separately provides a flash suppressor that can be retrofitted to an existing flash suppressor or other muzzle device.

The present disclosure separately provides a blast mitigation device that can be easily installed by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments of the present disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed embodiments of the present disclosure are provided herein. However, it is to be understood that the disclosed embodiments are merely exemplary of the present disclosure that may be embodied in various and alternative forms. The figures are not necessarily to scale and some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE PRESENT DISCLOSURE

Figure 1:
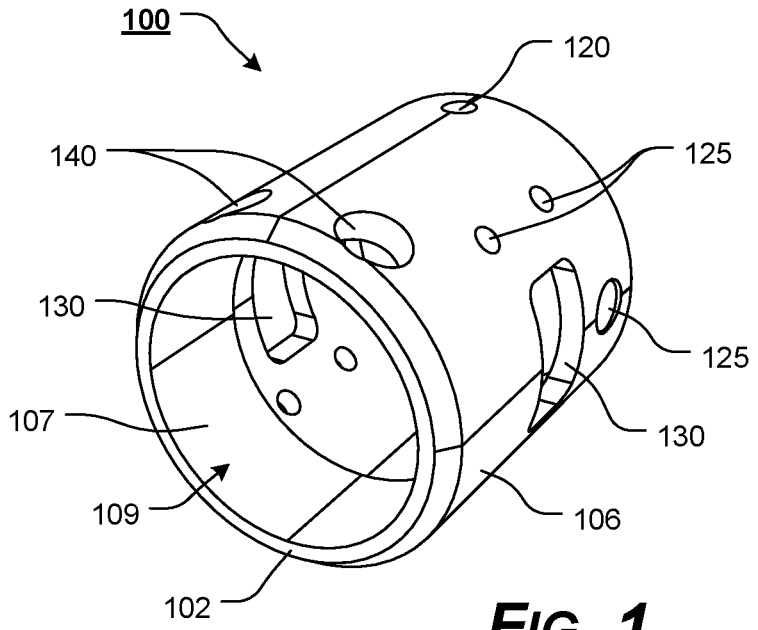
FIG. 1 shows an upper front perspective view of an exemplary embodiment of a collar, according to the present disclosure.
Figure 2:
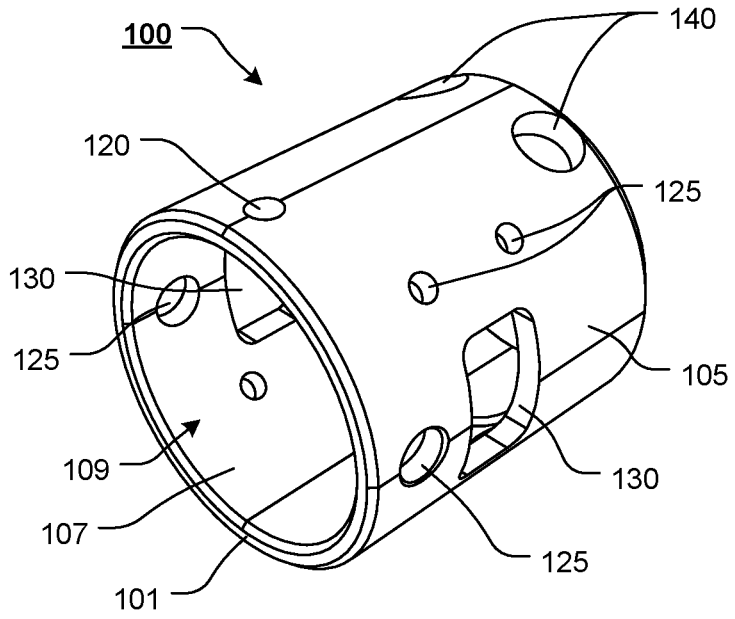
FIG. 2 shows an upper rear perspective view of an exemplary embodiment of a collar, according to the present disclosure.
Figure 3:
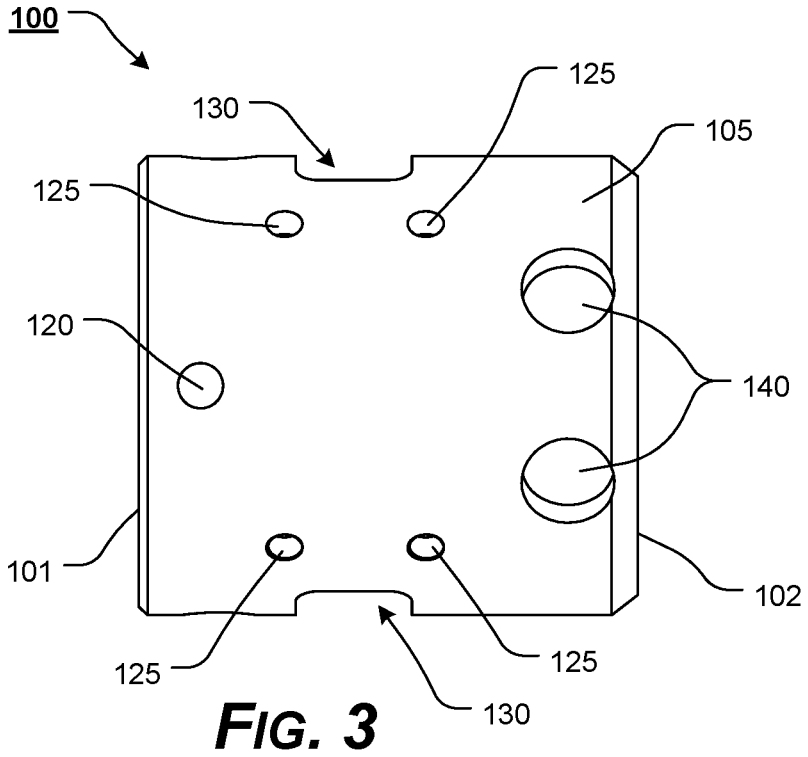
FIG. 3 shows a top view of an exemplary embodiment of a collar, according to the present disclosure.
Figure 4:
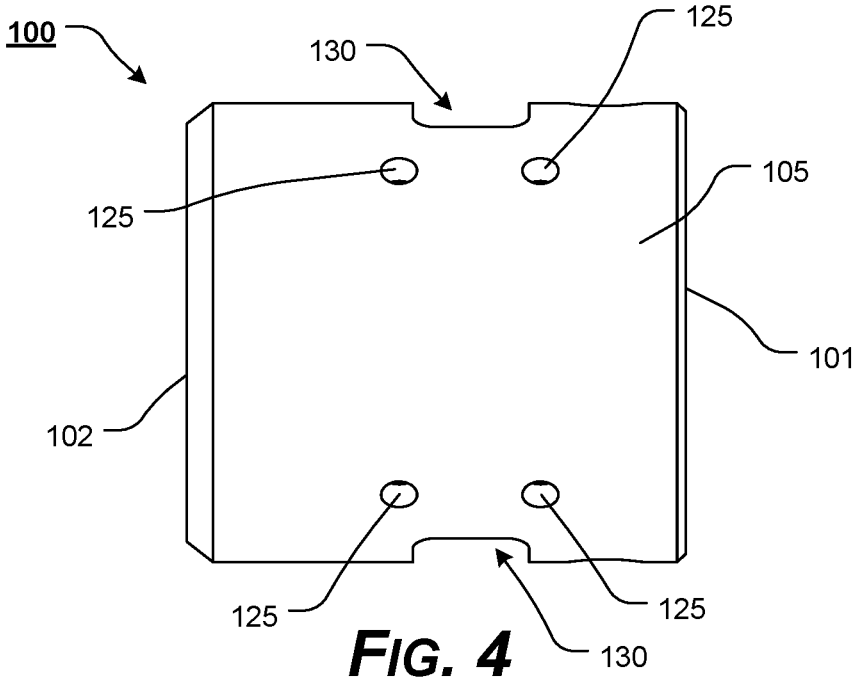
FIG. 4 shows a bottom view of an exemplary embodiment of a collar, according to the present disclosure.
Figure 5:
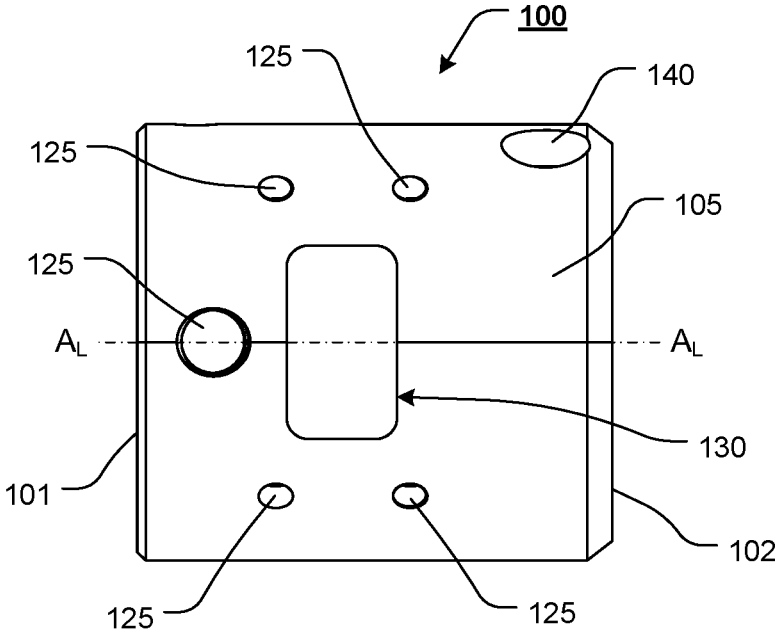
FIG. 5 shows a right side view of an exemplary embodiment of a collar, according to the present disclosure.
Figure 6:
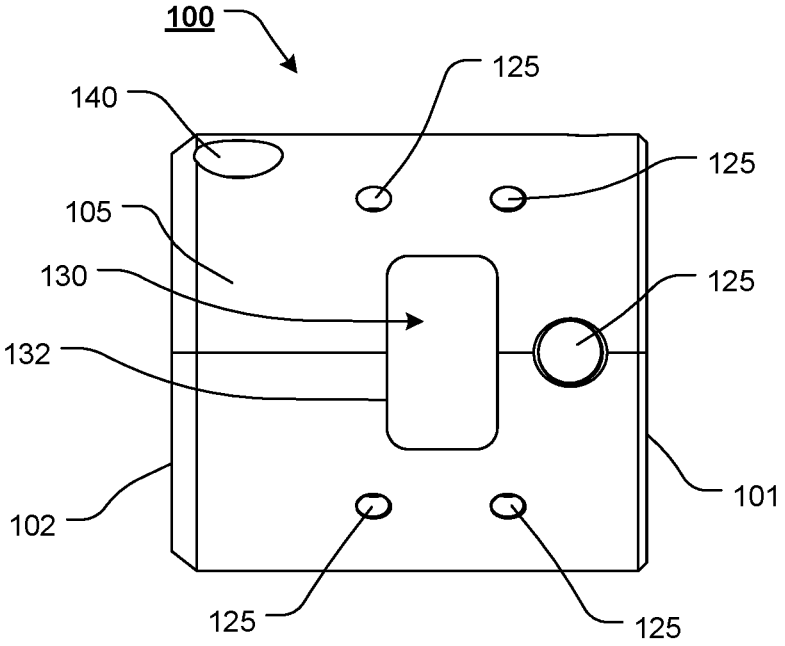
FIG. 6 shows a left side view of an exemplary embodiment of a collar, according to the present disclosure.
Figure 7:
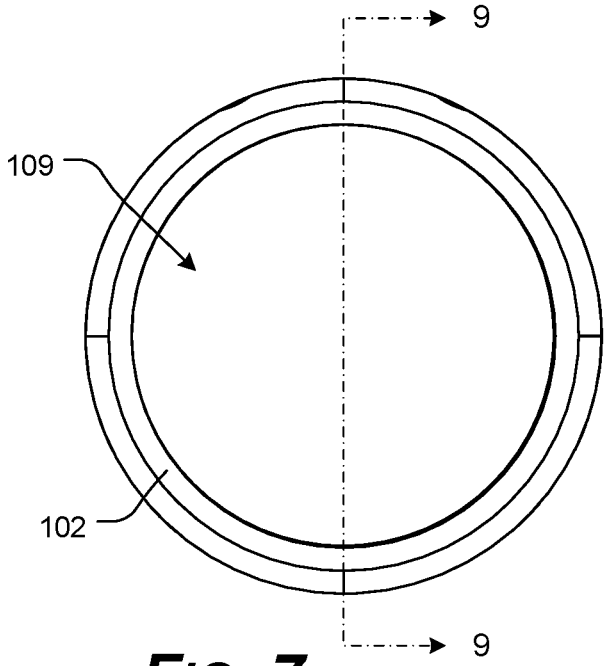
FIG. 7 shows a front view of an exemplary embodiment of a collar, according to the present disclosure.
Figure 8:
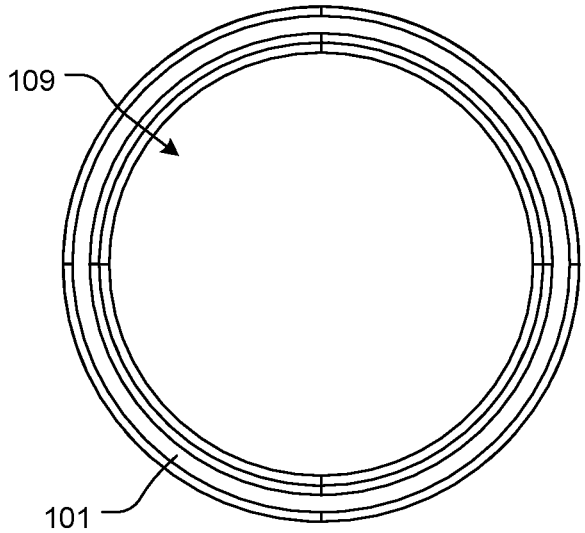
FIG. 8 shows a rear view of an exemplary embodiment of a collar, according to the present disclosure.
Figure 9:
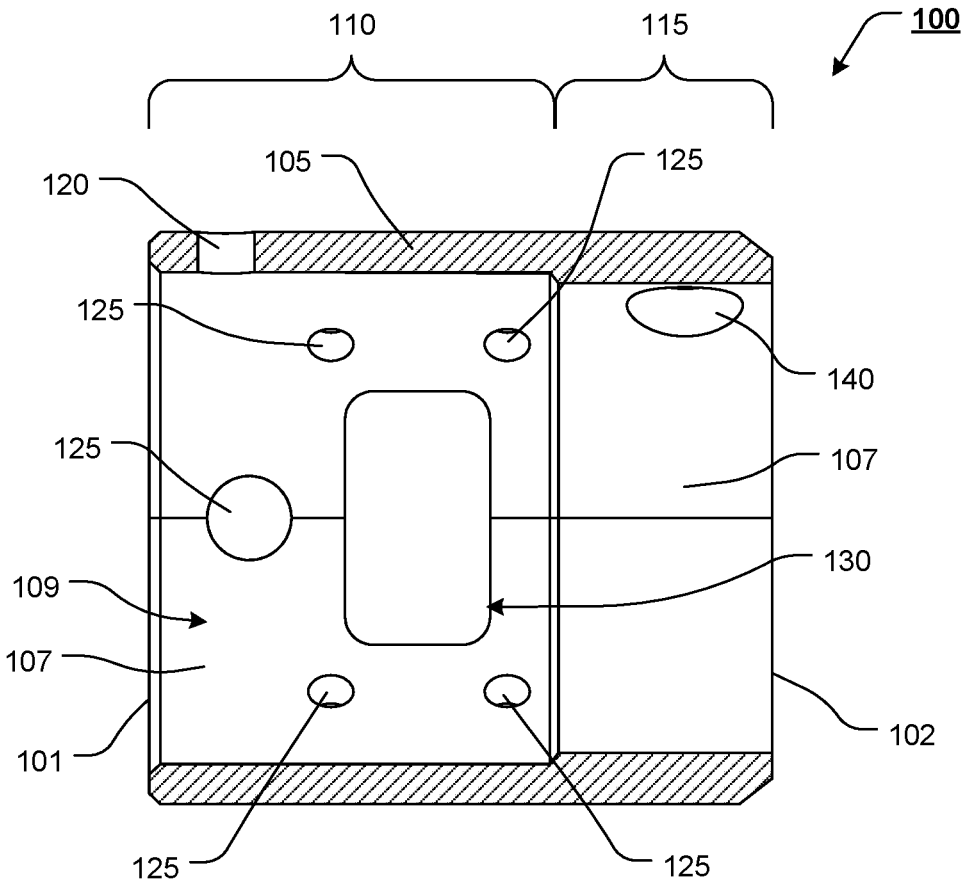
FIG. 9 shows side cross-sectional view taken along line 9-9 of the collar of FIG. 7, according to the present disclosure.
Figure 10:
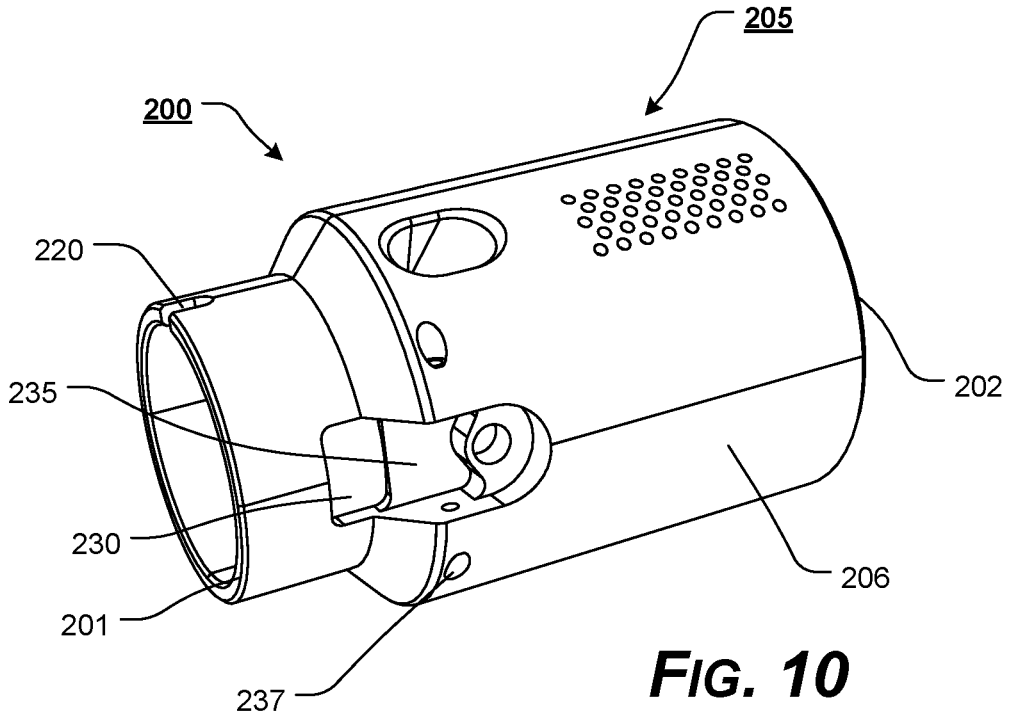
FIG. 10 shows an upper rear perspective view of an exemplary embodiment of a blast shield, according to the present disclosure.
Figure 11:
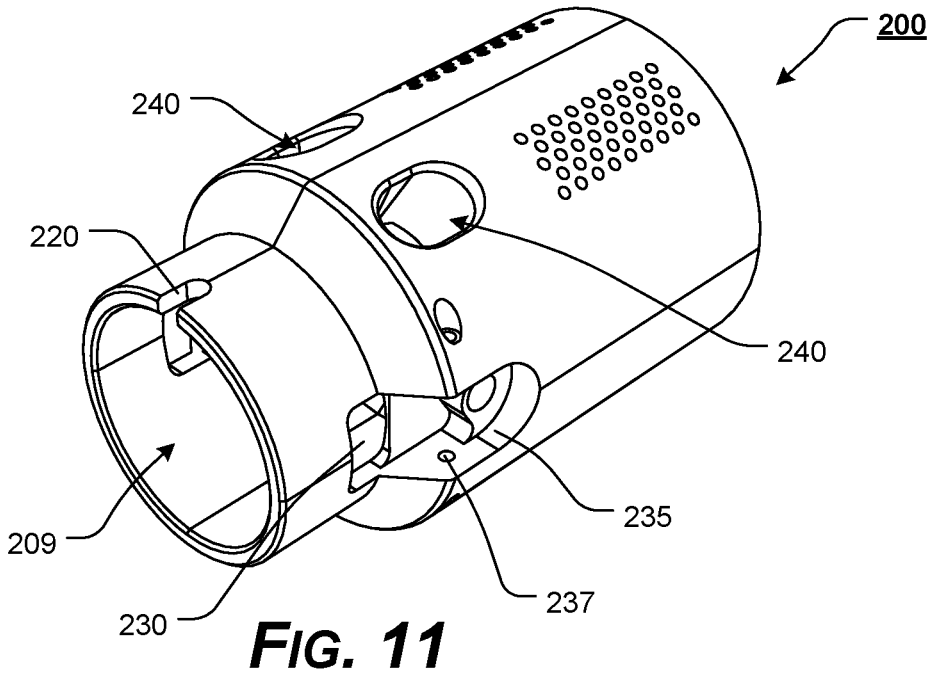
FIG. 11 shows an upper rear perspective view of an exemplary embodiment of a blast shield, according to the present disclosure.
Figure 12:
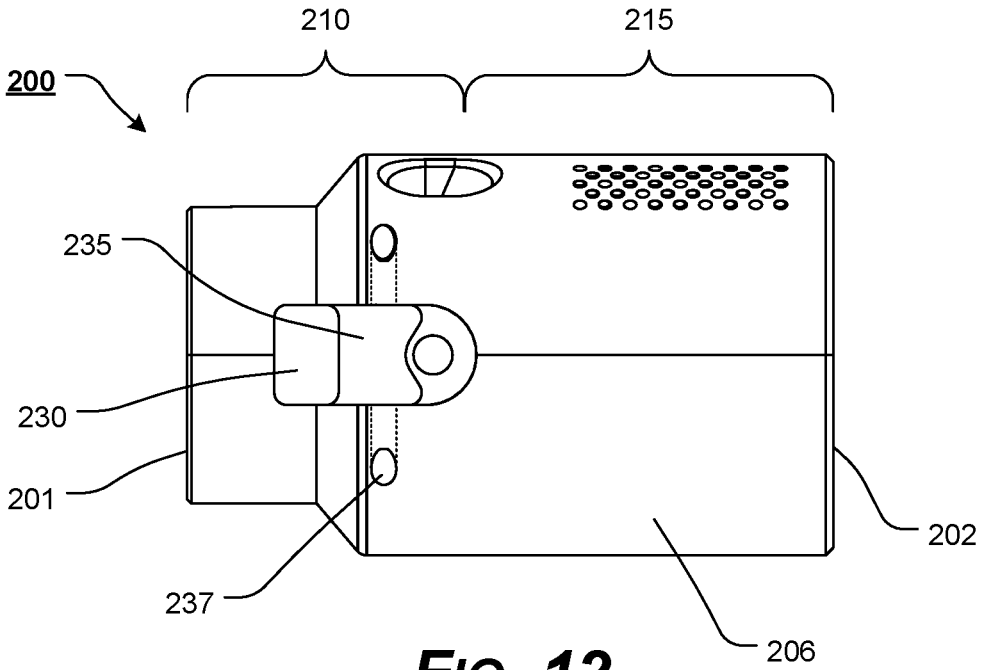
FIG. 12 shows a right side view of an exemplary embodiment of a blast shield, according to the present disclosure.
Figure 13:
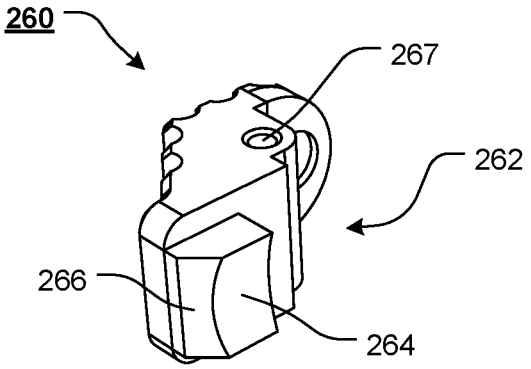
FIG. 13 shows an upper rear perspective view of an exemplary embodiment of a blast shield lever, according to the present disclosure.
Figure 14:
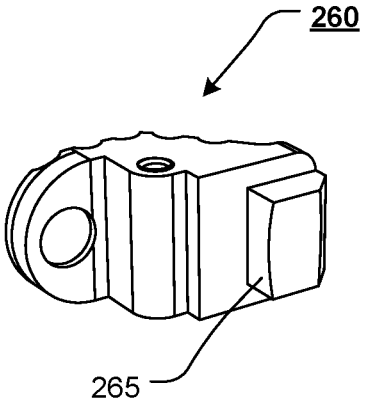
FIG. 14 shows an upper front perspective view of an exemplary embodiment of a blast shield lever, according to the present disclosure.
Figure 15:
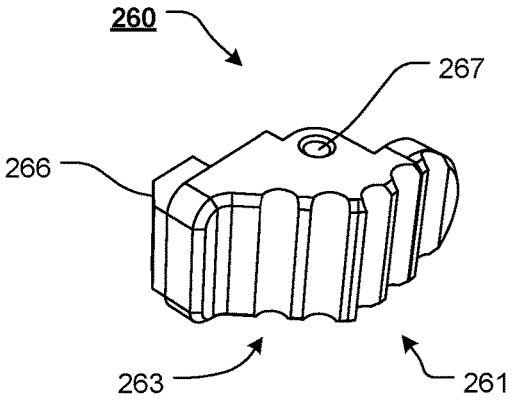
FIG. 15 shows a perspective view of an exemplary embodiment of a blast shield lever, according to the present disclosure.
Figure 16:
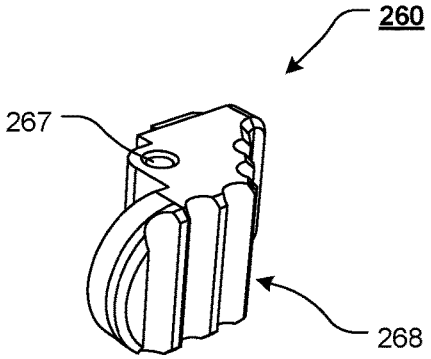
FIG. 16 shows a perspective view of an exemplary embodiment of a blast shield lever, according to the present disclosure.
Figure 17:
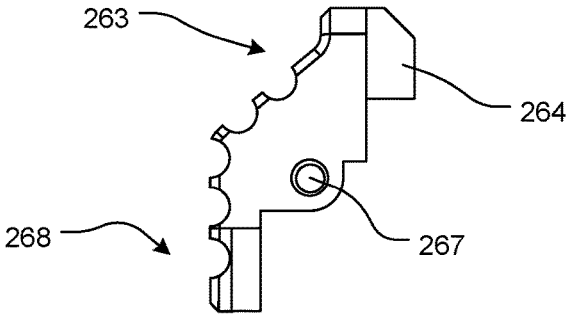
FIG. 17 shows a top view of an exemplary embodiment of a blast shield lever, according to the present disclosure.
Figure 18:
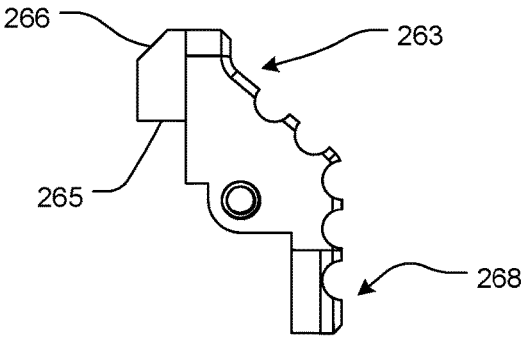
FIG. 18 shows a bottom view of an exemplary embodiment of a blast shield lever, according to the present disclosure.
Figure 19:
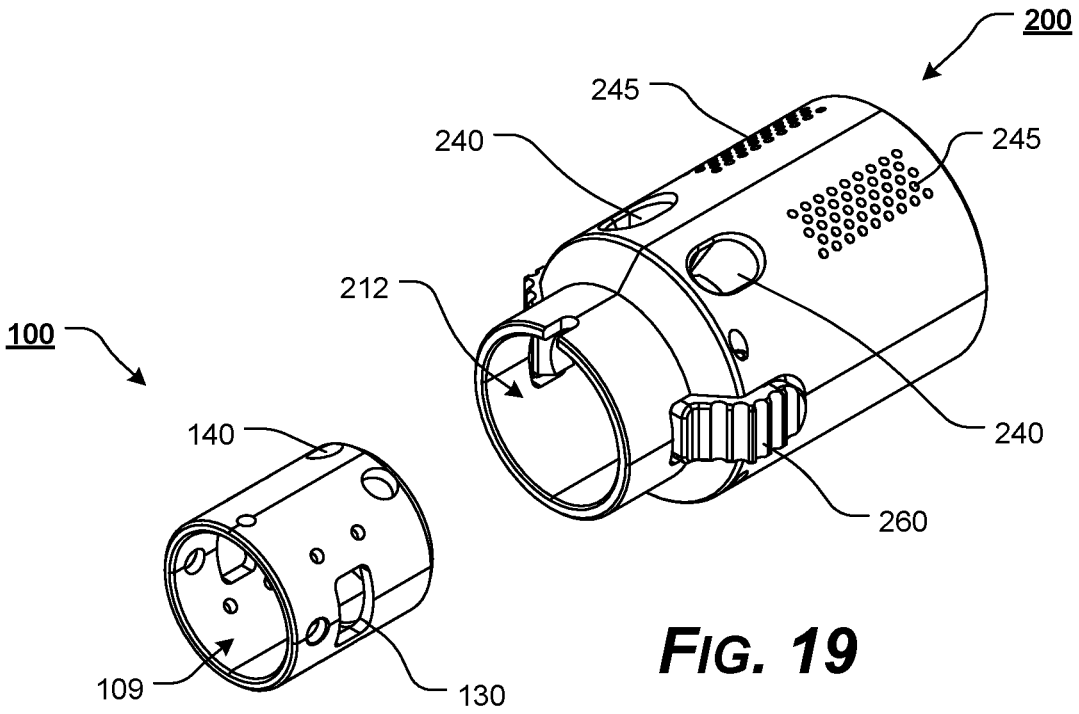
FIG. 19 shows an upper rear perspective view of an exemplary embodiment of a collar and an aligned blast shield, according to the present disclosure.
Figure 20:
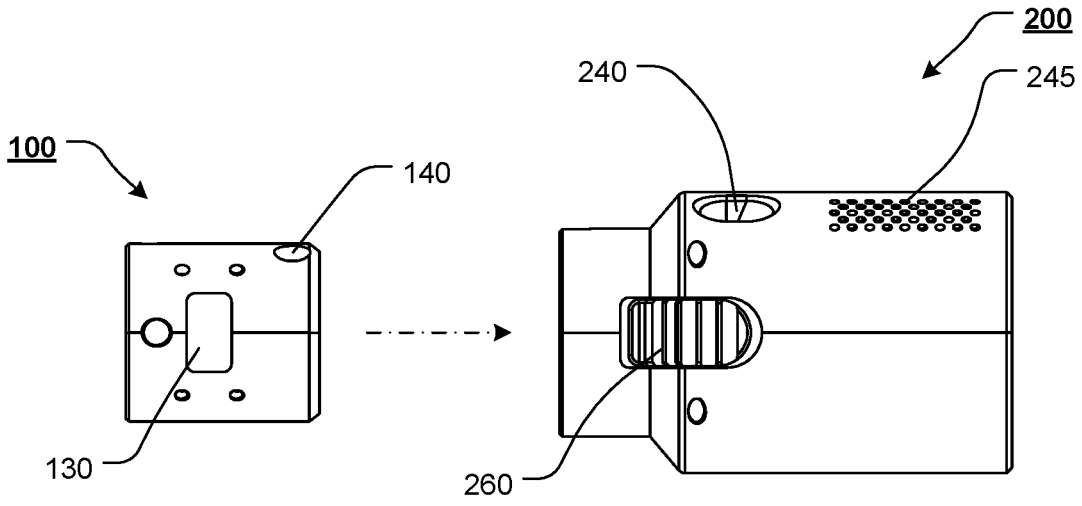
FIG. 20 shows a right side view of an exemplary embodiment of a collar and an aligned blast shield, according to the present disclosure.
Figure 21:
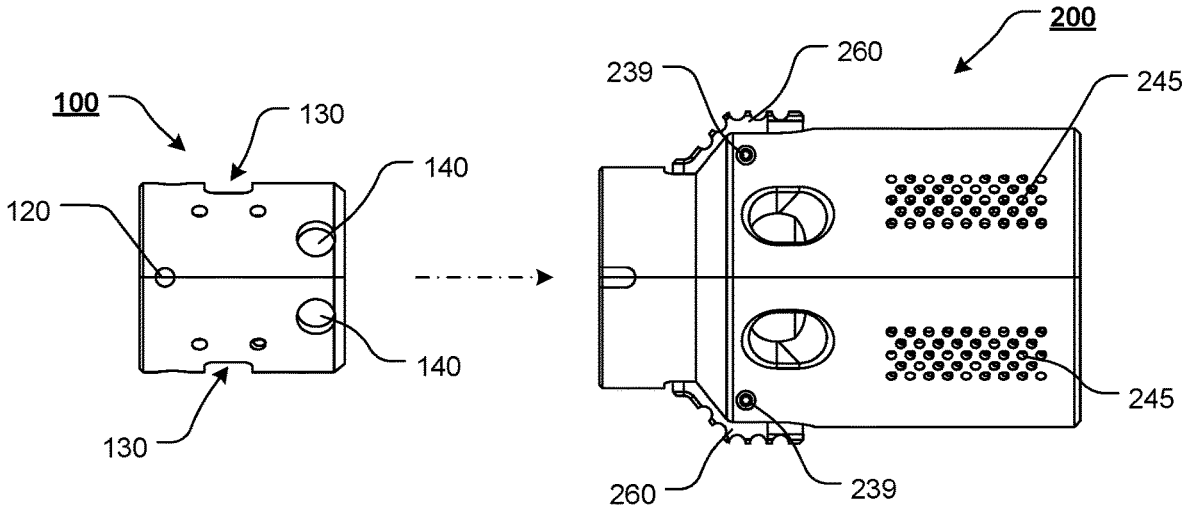
FIG. 21 shows a top view of an exemplary embodiment of a collar and an aligned blast shield, according to the present disclosure.
Figure 22:
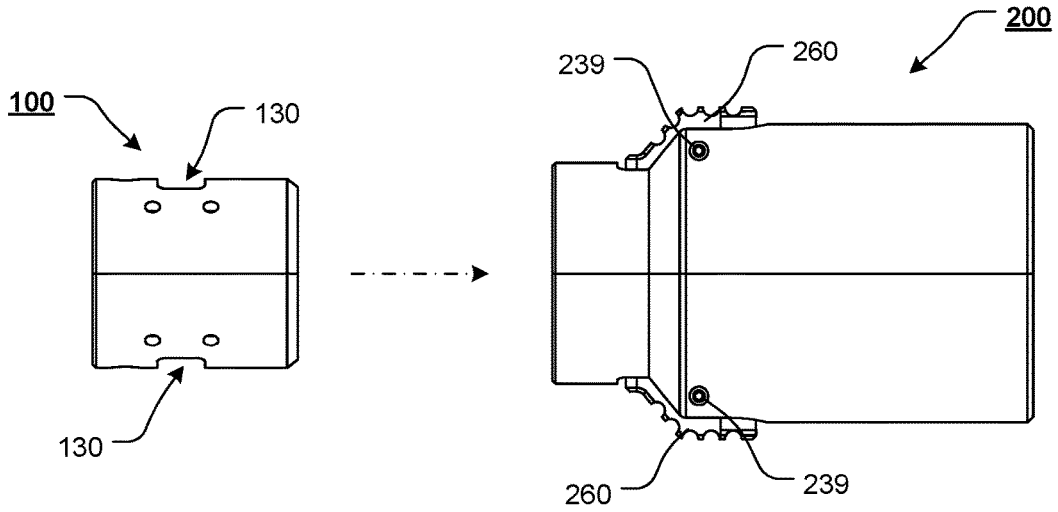
FIG. 22 shows a bottom view of an exemplary embodiment of a collar and an aligned blast shield, according to the present disclosure.
Figure 23:
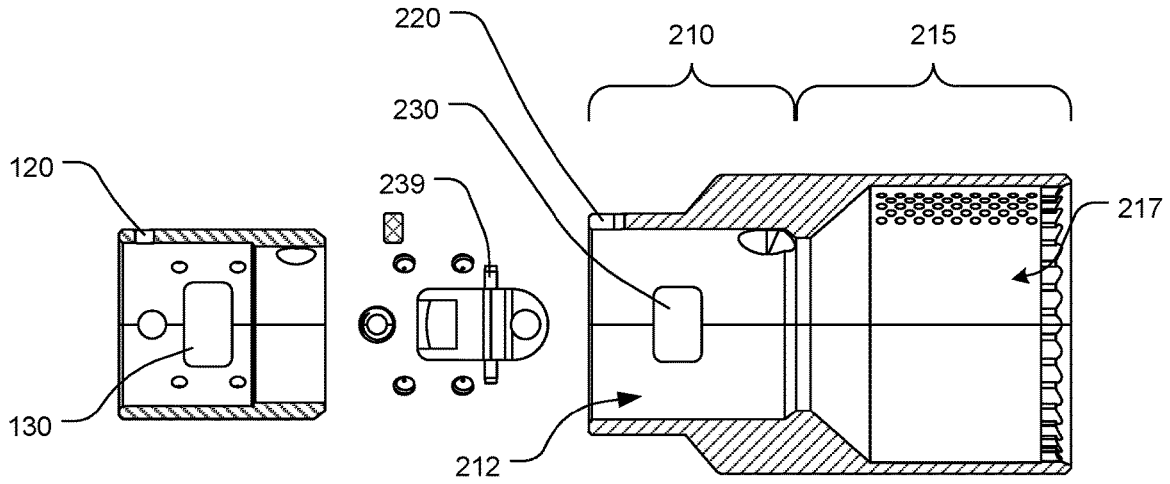
FIG. 23 shows a right side cross-sectional view, illustrating certain components of the exemplary embodiment of the collar and blast shield, according to the present disclosure.
Figure 24:
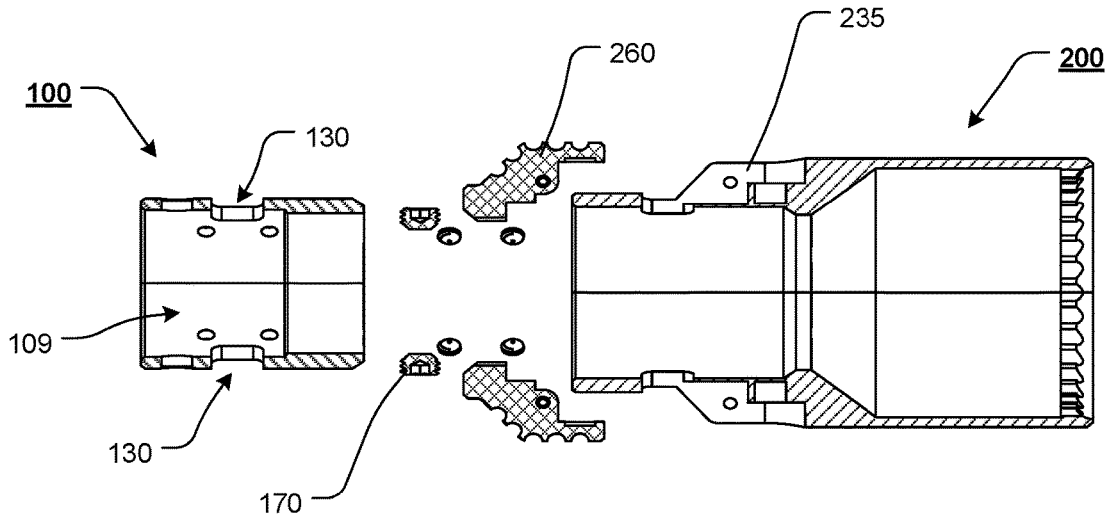
FIG. 24 shows a top cross-sectional view, illustrating certain components of the exemplary embodiment of the collar and blast shield, according to the present disclosure.
Figure 25:
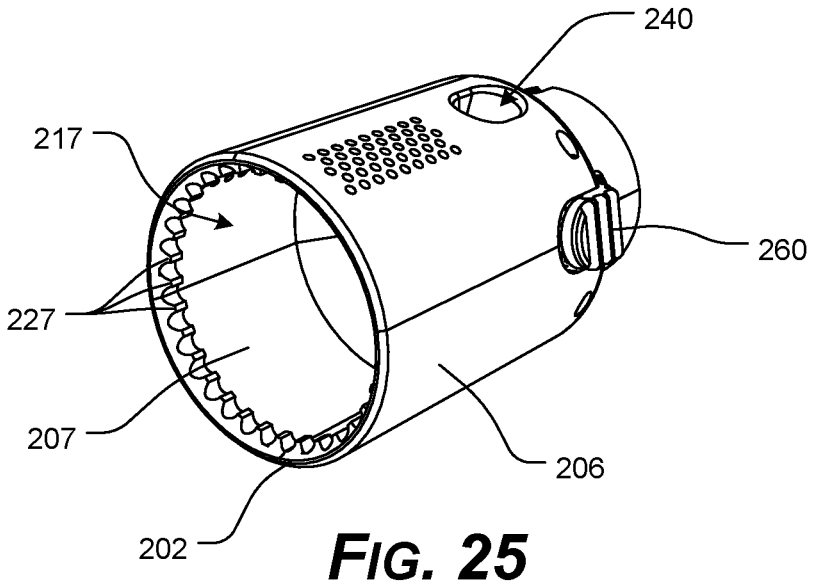
FIG. 25 shows a upper front perspective view of an exemplary embodiment of a blast mitigation device, according to the present disclosure.
Figure 26:
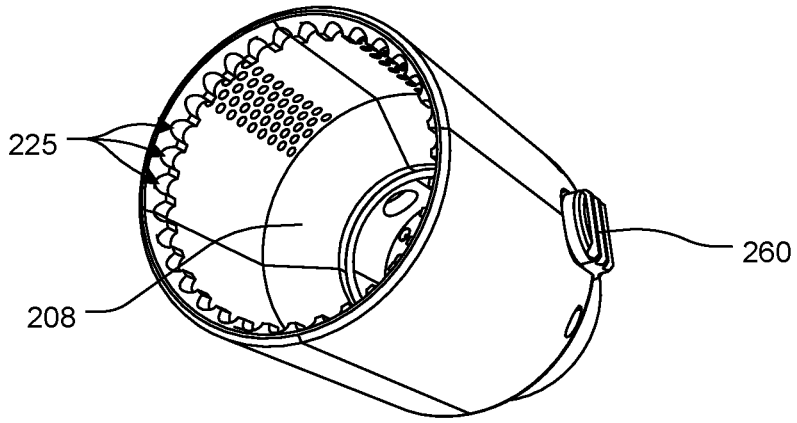
FIG. 26 shows a lower front perspective view of an exemplary embodiment of a blast mitigation device, according to the present disclosure.
Figure 27:
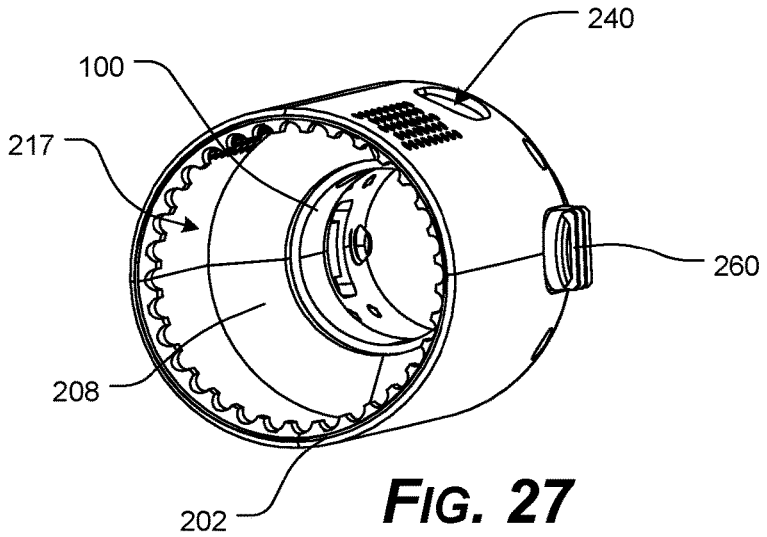
FIG. 27 shows a front perspective view of an exemplary embodiment of a blast mitigation device, according to the present disclosure.
Figure 28:
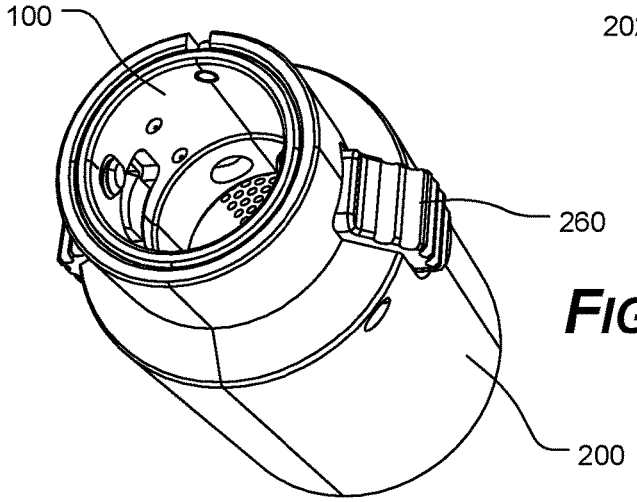
FIG. 28 shows a lower rear perspective view of an exemplary embodiment of a blast mitigation device, according to the present disclosure.
Figure 29:
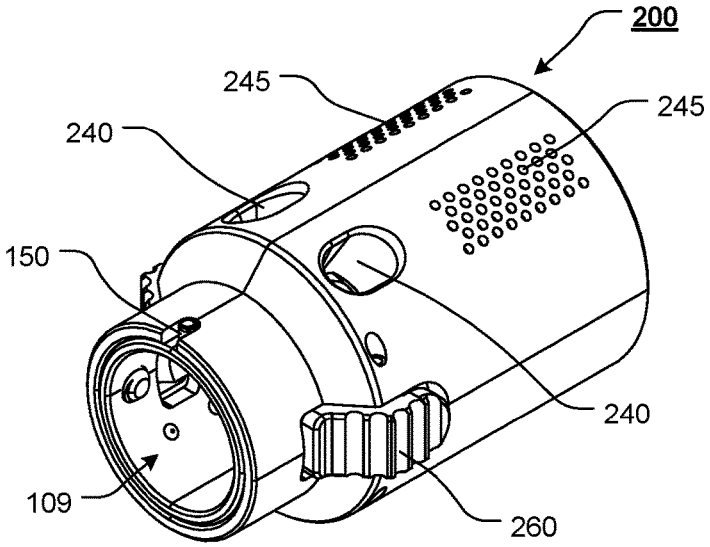
FIG. 29 shows an upper rear perspective view of an exemplary embodiment of a blast mitigation device, according to the present disclosure.
Figure 30:
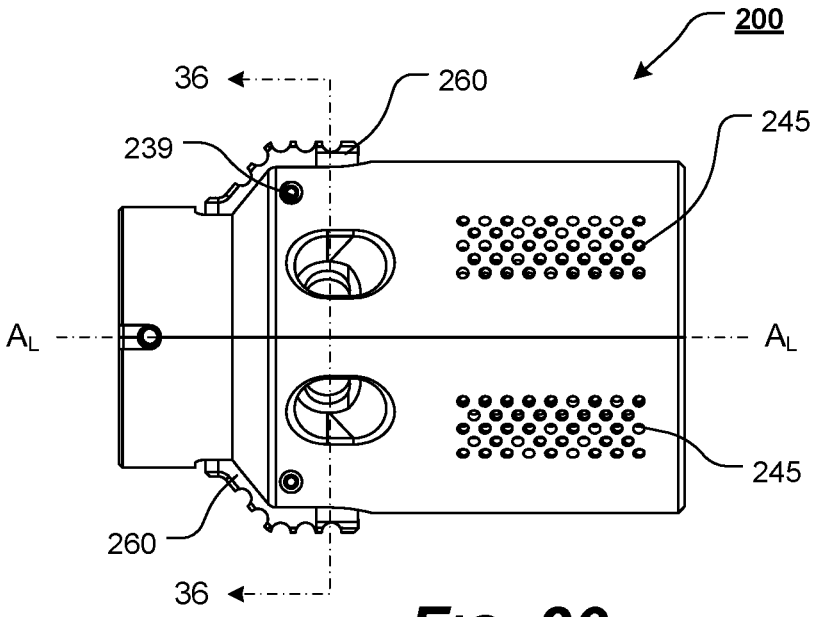
FIG. 30 shows a top view of an exemplary embodiment of a blast mitigation device, according to the present disclosure.
Figure 31:
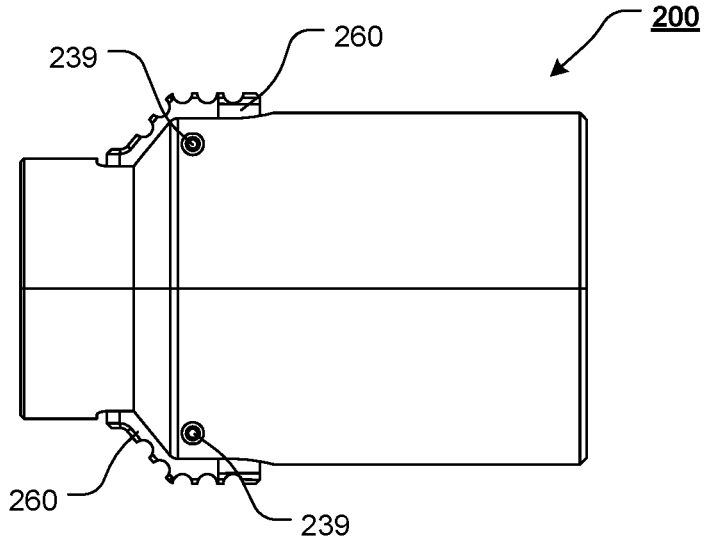
FIG. 31 shows a bottom view of an exemplary embodiment of a blast mitigation device, according to the present disclosure.
Figure 32:
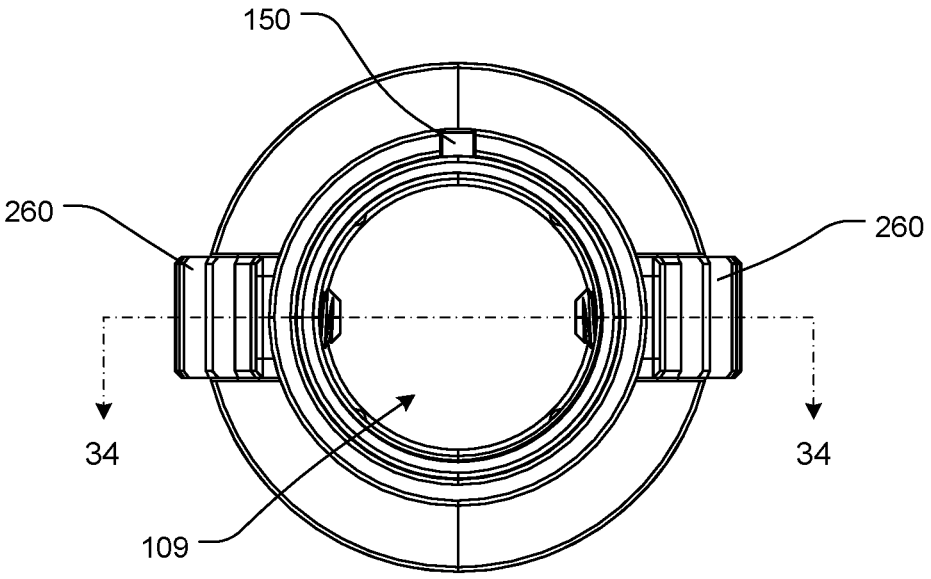
FIG. 32 shows a rear view of an exemplary embodiment of a blast mitigation device, according to the present disclosure.
Figure 33:
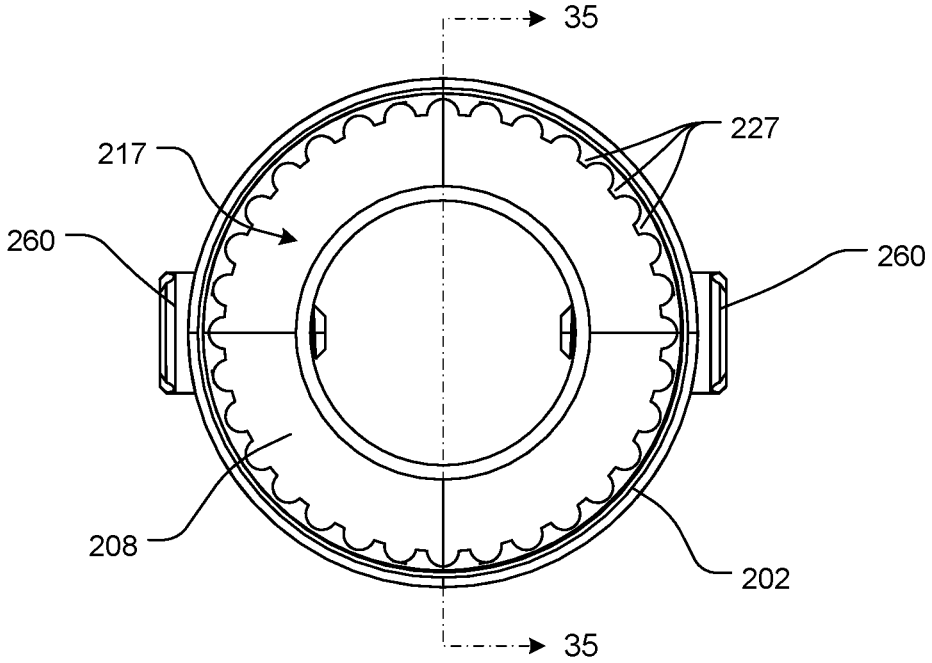
FIG. 33 shows a front view of an exemplary embodiment of a blast mitigation device, according to the present disclosure.
Figure 34:
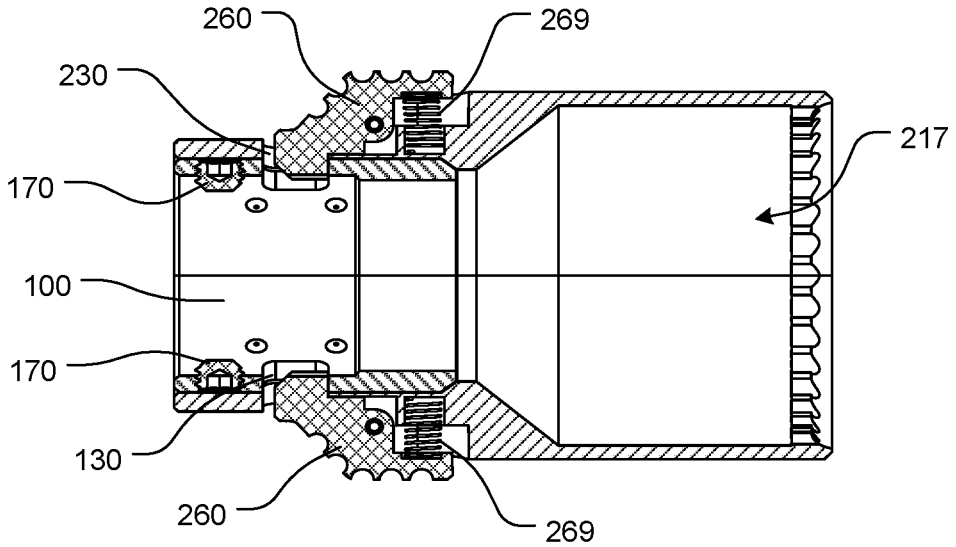
FIG. 34 shows a top cross-sectional view taken along line 34-34 of the blast mitigation device of FIG. 32.
Figure 35:
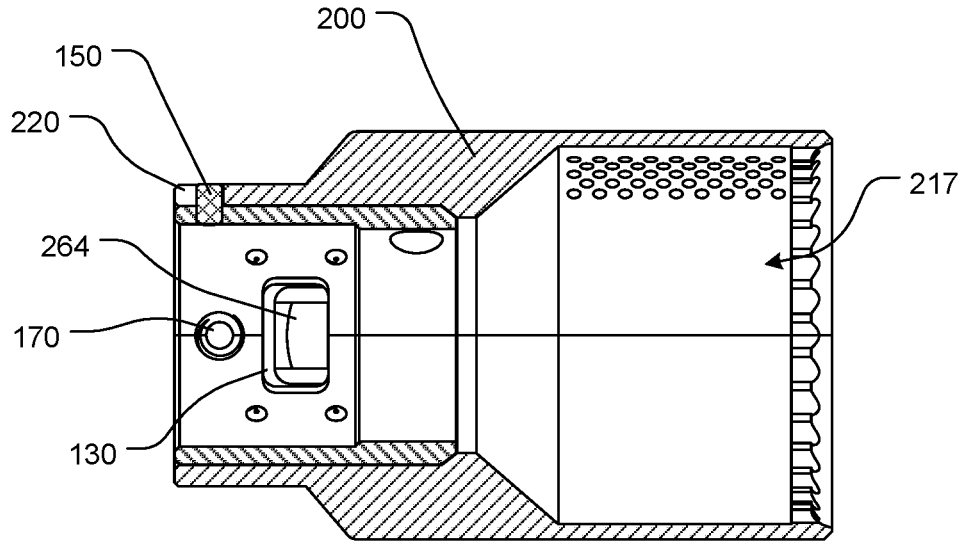
FIG. 35 shows a side cross-sectional view taken along line 35-35 of the blast mitigation device of FIG. 33.

For simplicity and clarification, the design factors and operating principles of the blast mitigation device and/or blast shield according to the present disclosure are explained with reference to various exemplary embodiments of a blast mitigation device and/or blast shield according to the present disclosure. The basic explanation of the design factors and operating principles of the blast mitigation device and/or blast shield is applicable for the understanding, design, and operation of the blast mitigation device and/or blast shield of the present disclosure. It should be appreciated that the blast mitigation device and/or blast shield can be adapted to many applications where a blast mitigation device and/or blast shield can be used.

It should also be appreciated that the terms "firearm", "blast mitigation device", and "blast shield" are used for basic explanation and understanding of the operation of the systems, methods, and apparatuses of the present disclosure. Therefore, the terms "firearm", "blast mitigation device", and "blast shield" are not to be construed as limiting the systems, methods, and apparatuses of the present disclosure.

For simplicity and clarification, the various embodiments of the blast mitigation devices and/or blast shields of the present disclosure will be described as being used in connection with a rifle barrel. However, it should be appreciated that these are merely exemplary embodiments of the blast mitigation devices and/or blast shields and are not to be construed as limiting this disclosure. Thus, the blast mitigation devices and/or blast shields of the present disclosure may be utilized in connection with any rifle, pistol, artillery piece, firearm, or other device.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Turning now to the drawing FIGS., FIGS. 1-44 illustrate certain elements and/or aspects of an exemplary embodiment of a blast mitigation device, according to the present disclosure. In certain illustrative, non-limiting embodiments of the present disclosure, as illustrated in FIGS. 1-44, the blast mitigation device comprises at least some of a collar 100 and a blast shield 200.

As illustrated most clearly in FIGS. 1-9, the collar 100 comprises an elongate portion of substantially cylindrical material that forms a collar body 105, which extends along a longitudinal axis $A_L$ from a first end 101 to a second end 102. The collar body 105 comprises an attachment portion 110 and an extension portion 115.

In certain exemplary embodiments, various components of the blast mitigation device, including the collar 100, are formed of steel. Alternate materials of construction of the various components of the collar 100 may include one or more of the following: stainless steel, aluminum, titanium, and/or other metals, as well as various alloys, combinations, and/or composites thereof. Thus, it should be understood that the material or materials used to form the collar 100 is a design choice based on the desired appearance, strength, and functionality of the collar 100.

While the collar 100 is shown and described as having a substantially cylindrical outer shape and a substantially cylindrical borehole or central collar aperture 109, it is to be in understood that the collar 100 may comprise any exterior or interior shape. Thus, while a substantially cylindrical shape would allow for ease in manufacturing and would conform with the customary use of cylindrical shaped muzzle brakes, the shape of the collar 100 is not limited to being substantially cylindrical and, for example, may be substantially oval, oblong, triangular, square, rectangular hexagonal, octagonal, etc.

The central collar aperture 109 is defined by one or more interior sidewalls 107 and has an inner diameter (or shape), which allows at least a portion of a flash suppressor or other muzzle device to be at least partially positioned within the central collar aperture 109, as illustrated most clearly in FIGS. 37-44. In various exemplary embodiments, the muzzle brake 300 illustrated in FIGS. 37-44 is an exemplary embodiment of the muzzle brake described in U.S. patent application Ser. No. 14/499,993, filed Sep. 29, 2014, the disclosure of which is incorporated herein in its entirety by reference.

An exterior portion of the collar 100 or collar body 105 is formed so as to be received within at least a portion of the blast shield 200, as described herein.

In various exemplary, nonlimiting embodiments, one or more mounting screw apertures 125 are provided at spaced apart locations around the collar body 105. The size, shape, number, and placement of each of the mounting screw apertures 125 is a design choice, based upon the desired degree of frictional or other attachment between the collar 100 and muzzle brake 300 to which the collar 100 is attached or coupled. As illustrated, the mounting screw apertures 125 are generally provided at spaced apart locations, such that mounting screw apertures 125 are positioned opposite one another so that when mounting screws 170 are threaded inserted within each of the mounting screw apertures 125, resulting frictional pressure may be applied equally to opposing sides of the collar 100.

The mounting screws 170 are selected so as to be received within the mounting screw apertures 125 such that the mounting screws 170 may be received a sufficient distance within the mounting screw apertures 125 so that a top of each mounting screw 170 is at least flush with, and potentially below, an outer surface of the collar body 105. In this manner, the mounting screws 170 do not extend beyond a surface of the collar body 105 and the blast shield 200 may be appropriately fitted to the collar 100.

While the collar 100 is shown having four sets of opposing, comparatively smaller mounting screw apertures 125 and one set of opposing, comparatively larger mounting screw apertures 125, it should be understood that this is merely exemplary and not limiting.

One or more locking notches 130 are provided through at least a portion of the collar body 105. In various exemplary embodiments, two, opposing locking notches 130 are provided on the collar body 105. In certain exemplary embodiments, the locking notches 130 are defined by sidewalls 132 of the locking notch 130 that extend completely through the collar body 105 and define the locking notches 130. Alternatively, the sidewalls 132 of the locking notches 130 only extend into a portion of the collar body 105 and do not extend completely through the collar body 105.

One or more collar venting apertures 140 are formed through the collar body 105 so as to allow fluid communication between the exterior of the collar 100 and the central collar aperture 109 of the collar 100. Thus, the one or more collar venting apertures 140 allow fluid communication between the central collar aperture 109 of the collar 100 and the outside surface of the collar 100.

Figure 36:
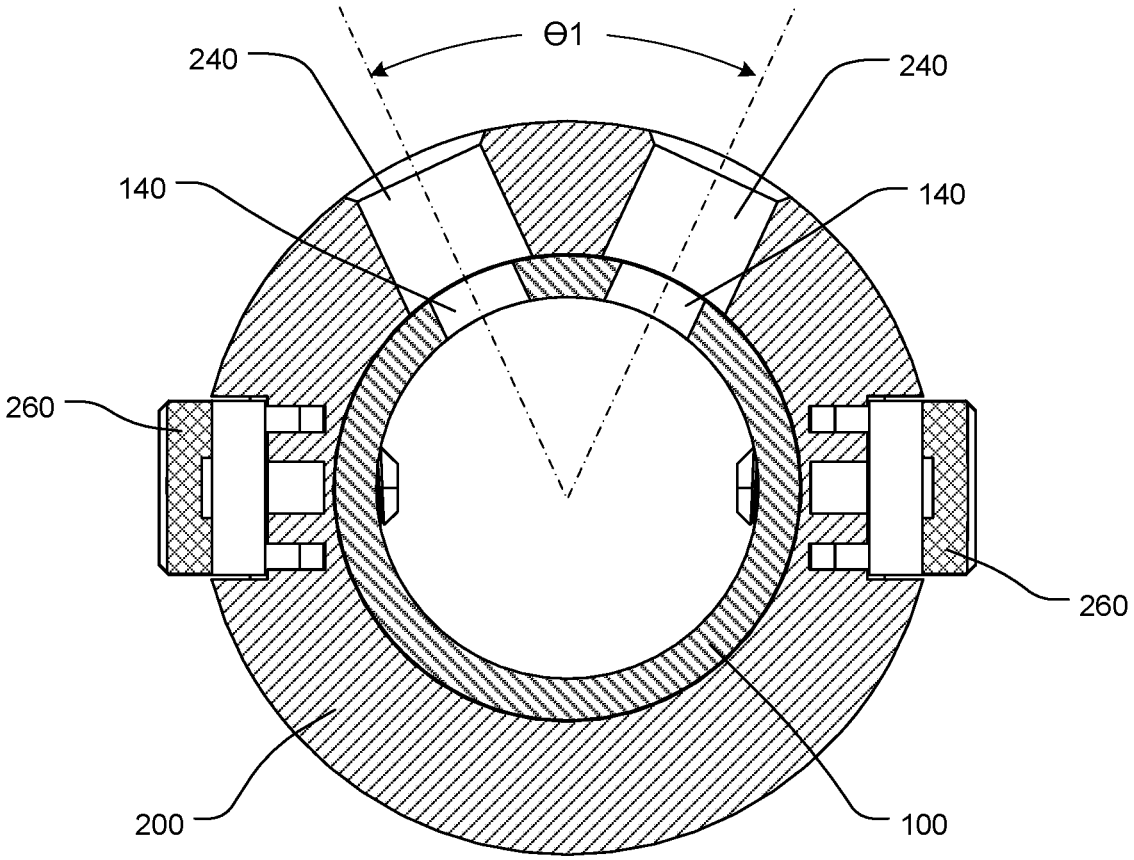
FIG. 36 shows a front cross-sectional view taken along line 36-36 of the blast mitigation device of FIG. 30.
Figure 37:
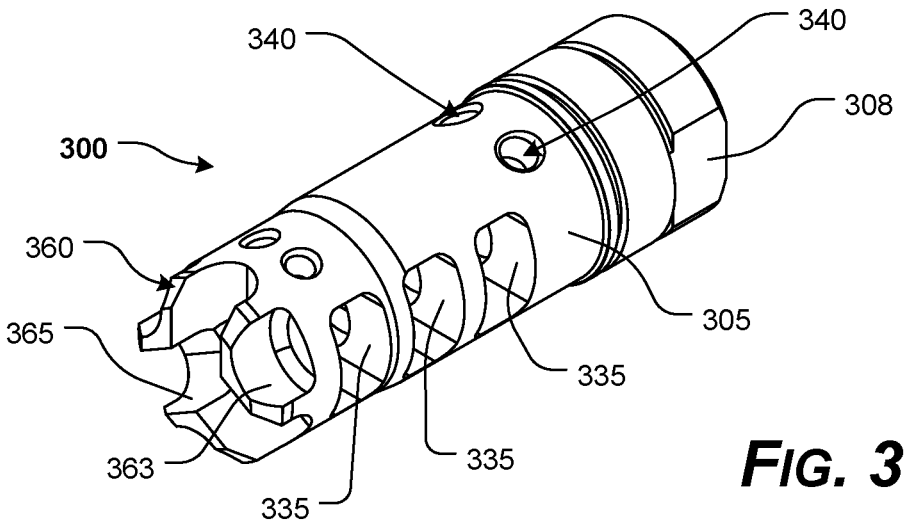
FIG. 37 shows a upper front perspective view of an exemplary embodiment of a flash suppressor or muzzle device that may optionally be used in conjunction with the blast mitigation device, according to the present disclosure.
Figure 38:
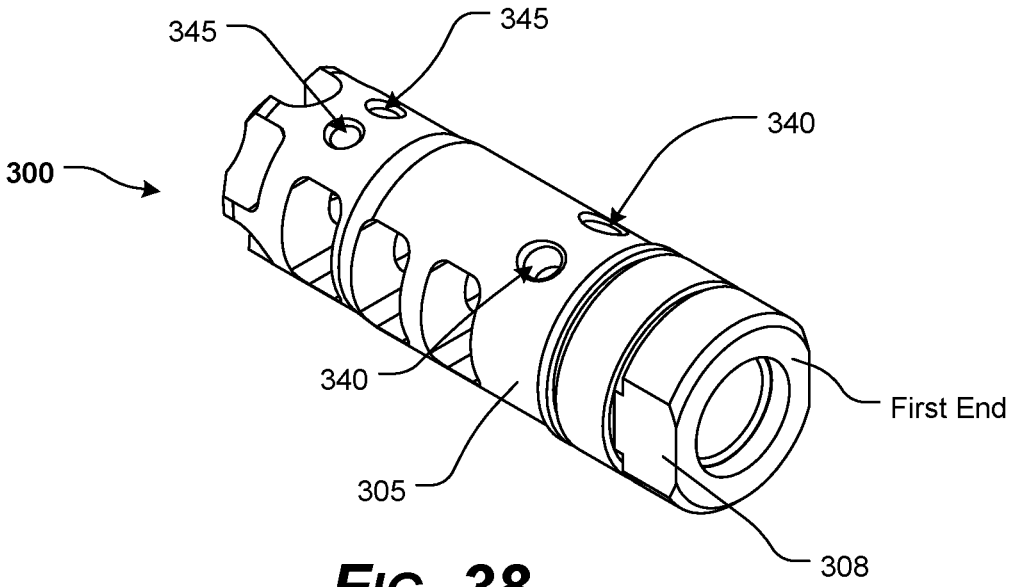
FIG. 38 shows a upper rear perspective view of an exemplary embodiment of a flash suppressor or muzzle device that may optionally be used in conjunction with the blast mitigation device, according to the present disclosure.
Figure 39:
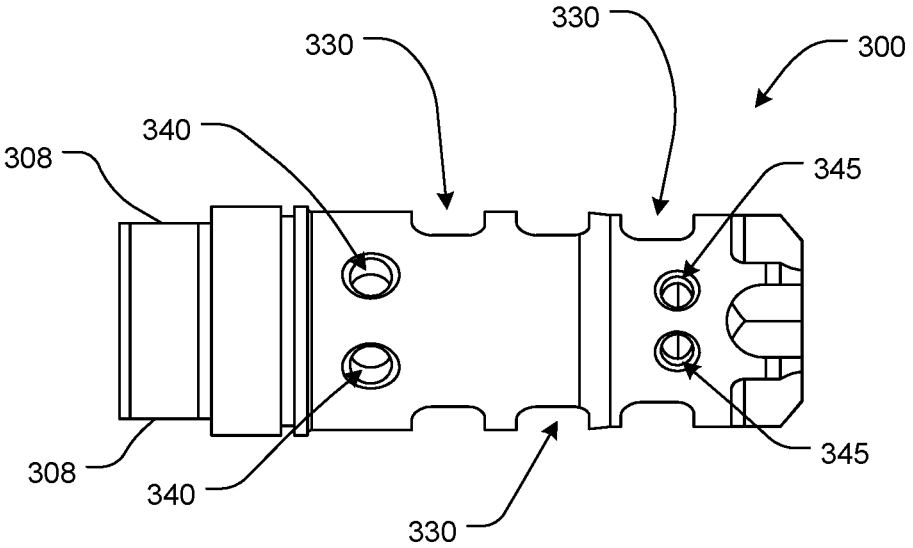
FIG. 39 shows a top view of an exemplary embodiment of a flash suppressor or muzzle device that may optionally be used in conjunction with the blast mitigation device, according to the present disclosure.
Figure 40:
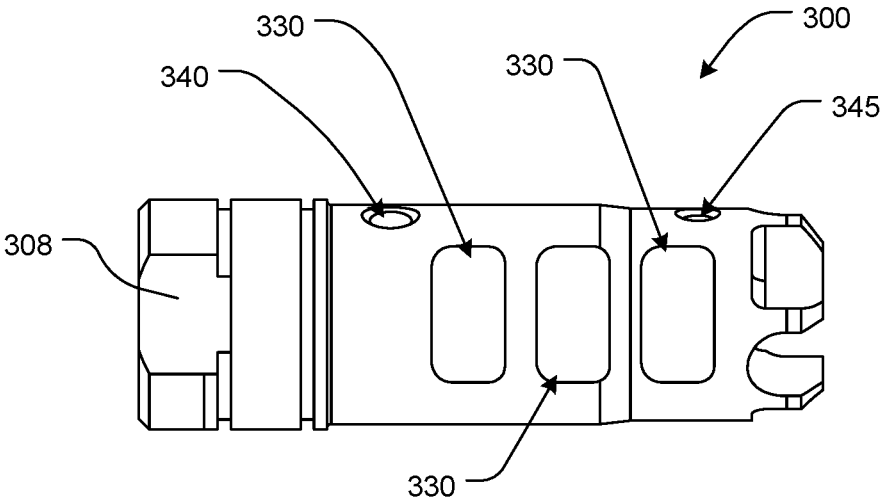
FIG. 40 shows a right side view of an exemplary embodiment of a flash suppressor or muzzle device that may optionally be used in conjunction with the blast mitigation device, according to the present disclosure.

As illustrated most clearly in FIG. 36, the collar venting apertures 140 are formed at an acute angle θ1 relative to one another. Each collar venting aperture 140 is formed at the same angle θ1 as the angles at which the blast shield venting apertures 240 and the muzzle brake venting aperture 340 are formed.

As illustrated, the collar venting apertures 140 have substantially parallel sidewalls and have a substantially cylindrical or oblong shape. Alternatively, one or more of the collar venting apertures 140 may be tapered or reversed tapered and may take on other shapes. Thus, it should be understood that the overall angle, diameter, size, and shape of each collar venting aperture 140 is a design choice based upon the desired functionality (i.e. fluid capacity, fluid flow characteristics, etc.) of the collar 100.

FIGS. 10-36 illustrate certain elements and/or aspects of an exemplary embodiment of a blast shield 200 to optionally be used in conjunction with the blast mitigation devices of the present disclosure.

As illustrated, the blast shield 200 comprises a body portion or blast shield body 205 that extends along a longitudinal axis $A_L$ from an open first end 201 to an open second end 202. The blast shield body 205 comprises a blast shield attachment portion 210 and a blast cup portion 215.

In certain exemplary embodiments, various components of the blast shield 200, including the blast shield body 205, are formed of steel. Alternate materials of construction of the various components of the blast shield 200 may include one or more of the following: stainless steel, aluminum, titanium, and/or other metals, as well as various alloys, combinations, and/or composites thereof. Thus, it should be understood that the material or materials used to form the blast shield 200 is a design choice based on the desired appearance, strength, and functionality of the blast shield 200.

While the blast shield attachment portion 210 and the blast cup portion 215 are shown and described as being substantially cylindrical in shape, it is to be distinctly understood that the blast shield attachment portion 210 and the blast cup portion 215 may comprise any shape. Thus, while a substantially cylindrical outer shape would allow for ease in manufacturing and would conform with the customary use of cylindrical shaped muzzle brakes, the shape of the blast shield 200 (and the blast shield attachment portion 210 and/or blast cup portion 215) is not limited to being substantially cylindrical and, for example, may be substantially oval, oblong, triangular, square, rectangular hexagonal, octagonal, etc.

A collar receiving recess 212 extends along the central borehole 209 from the first end 101 to a recess shoulder. The collar receiving recess 212 is adapted to receive at least a portion of the collar 100 within the collar receiving recess 212 so as to allow the blast shield levers 260 to engage the locking notches 130 and secure the blast shield 200 to the collar 100. Thus, it should be appreciated that the size and shape of the collar receiving recess 212 such that the collar 100 can be appropriately received within at least a portion of the collar recess.

In various exemplary embodiments, the collar receiving recess 212 is initiated by a beveled portion. If included, the beveled portion may allow for improved ease of inserting the collar 100 within the collar receiving recess 212.

In certain exemplary embodiments, the exterior shape of the collar 100 and the interior shape of the collar receiving recess 212 are formed such that, when attached or coupled together, the blast shield 200 is oriented in a determined fashion relative to the collar 100. Alternatively, the collar 100 may include at least one alignment pin collar recess 120 that allows an alignment pin 150 to be positioned at least partially therein, to be aligned with an alignment pin blast shield recess 220. Thus, by aligning alignment pin collar recess 120 with the alignment pin blast shield recess 220 and maintaining the alignment, via an alignment pin 150, the blast shield 200 is oriented in a determined fashion relative to the collar 100.

The cup portion 215 includes an internal cavity 217 defined by one or more internal cup sidewalls 207 and one or more internal cup bottom walls 208. The internal cavity 217 extends from the one or more internal cup bottom walls 208, along the one or more sidewalls, to an open top end that corresponds to the open second end 202 of the blast shield 200. In various exemplary embodiments, the internal cavity 217 is a substantially cylindrical internal cavity 217. However, it should be appreciated that the internal size, shape, and configuration of the internal cavity 217 is a design choice based upon the desired functionality and/or ornamental appearance of the blast shield 200.

It should also be appreciated that the one or more external cup sidewalls 206 may also form a substantially cylindrical external cup sidewall 206 or may form a different shape. Additionally, it should also be appreciated that the form of the external cup sidewalls 206 may be the same or different from the form of the internal sidewalls. For example, the external cup sidewalls 206 may form a substantially cylindrical external cup sidewall 206, while the interior cup sidewalls may take on a different shape, such as, for example, a substantially octagonal shape.

In various exemplary embodiments, a portion of the interior cup sidewalls includes a plurality of relief cuts 225 formed proximate the open second end 202. If included, the plurality of relief cuts 225 define a plurality of blast shield teeth 227. If included, the blast shield teeth 227 provide for further disruption of propellant gases as they are expelled from the open second end 202 of the blast shield 200.

A central borehole 209 extends through the blast shield 200, generally along the longitudinal axis $A_L$ of the blast shield 200. The central borehole 209 has at least a first central borehole diameter D1 within the collar receiving recess 212 and a second central borehole diameter D2 within the internal cavity 217.

The blast shield 200 includes one or more primary blast shield venting apertures 240 formed through the primary blast shield body 205 so as to allow fluid communication between the exterior of the primary blast shield 200 and the collar receiving recess 212 of the primary blast shield 200. Thus, the one or more primary blast shield venting apertures 240 allow fluid communication between the collar receiving recess 212 of the blast shield 200 and the outside surface of the blast shield 200.

Figure 44:
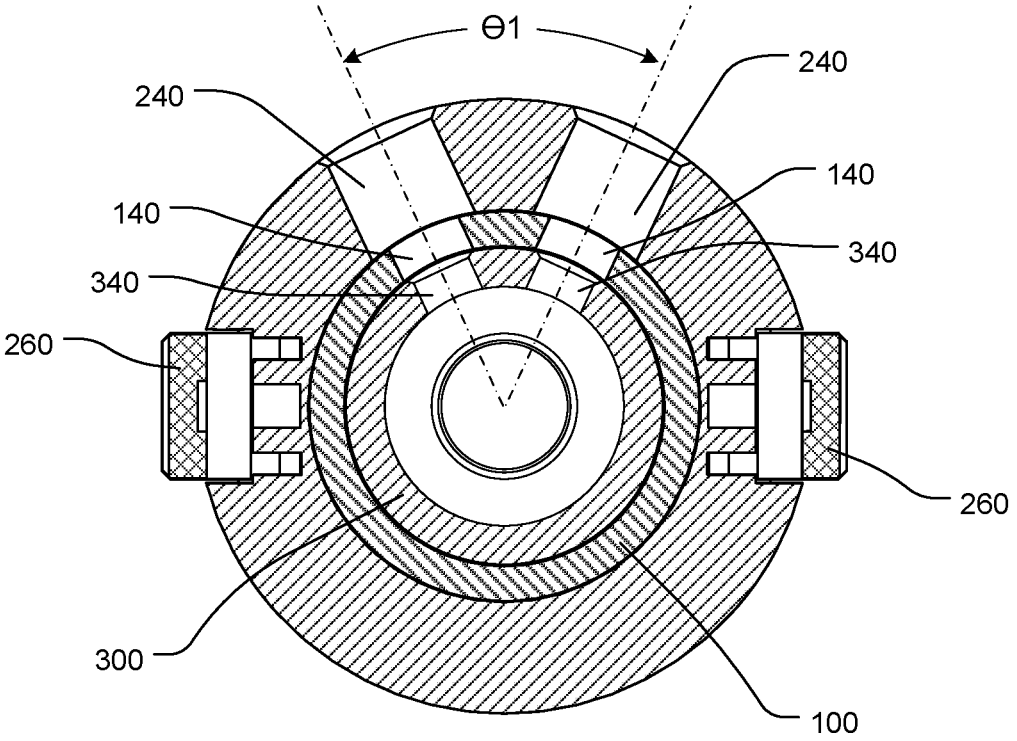
FIG. 44 shows a front cross-sectional view taken along line 36-36 of the blast mitigation device of FIG. 30, including an exemplary embodiment of a flash suppressor or muzzle device attached or coupled thereto.
Figure 45:
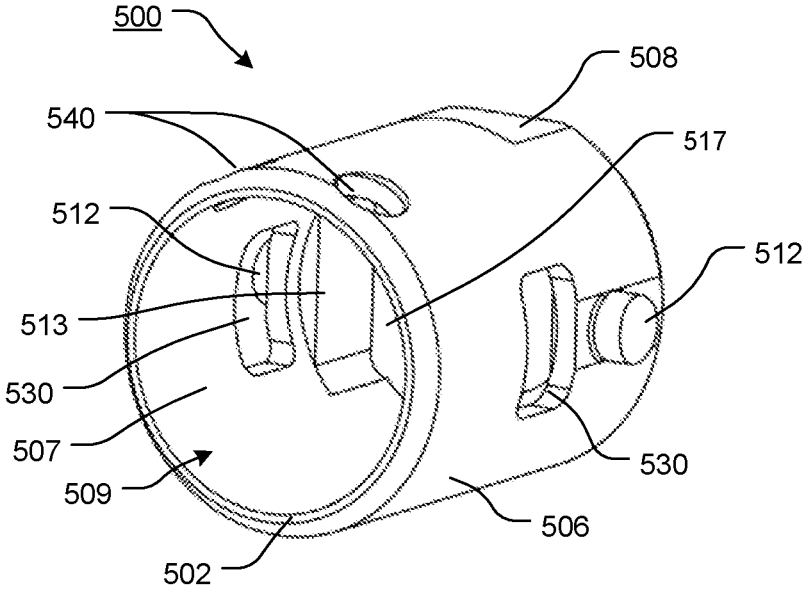
FIG. 45 shows an upper front perspective view of an exemplary embodiment of a collar, according to the present disclosure.
Figure 46:
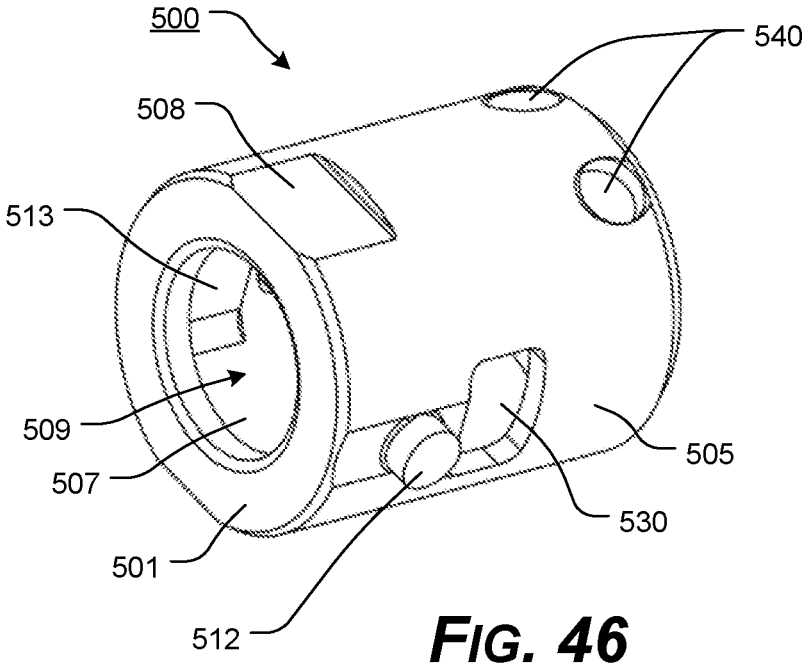
FIG. 46 shows an upper rear perspective view of an exemplary embodiment of a collar, according to the present disclosure.
Figure 47:
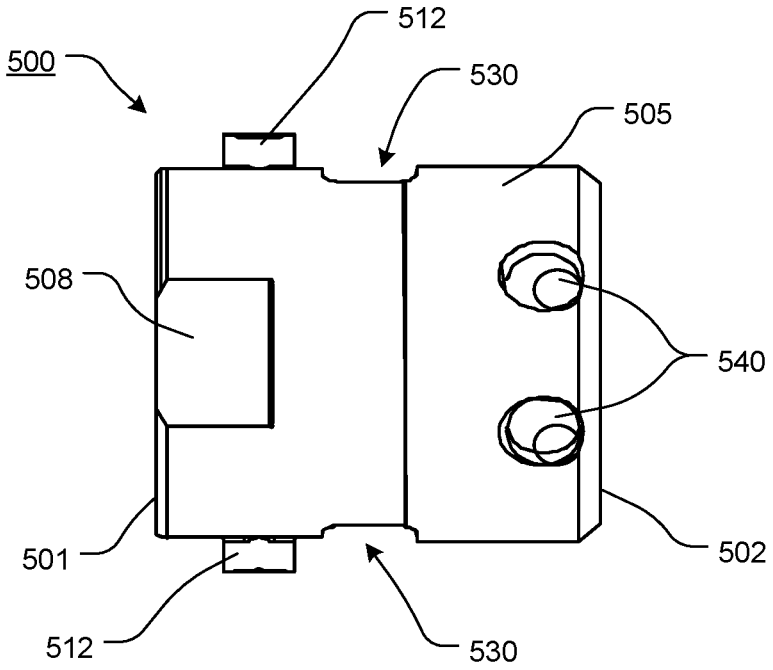
FIG. 47 shows a top view of an exemplary embodiment of a collar, according to the present disclosure.
Figure 48:
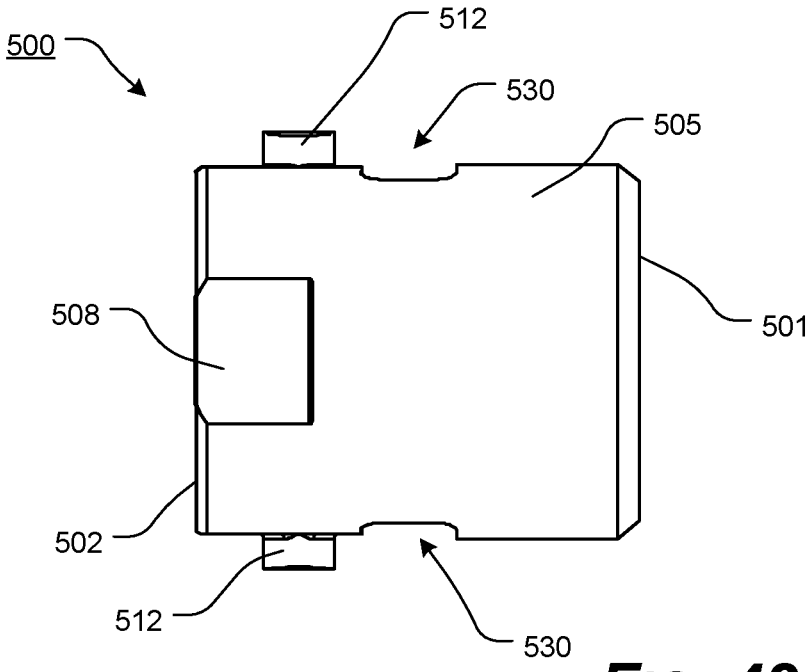
FIG. 48 shows a bottom view of an exemplary embodiment of a collar, according to the present disclosure.
Figure 49:
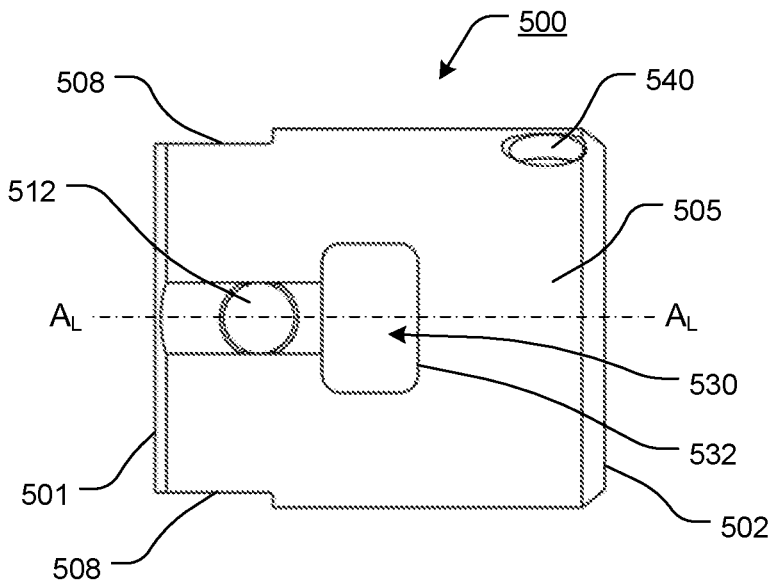
FIG. 49 shows a right side view of an exemplary embodiment of a collar, according to the present disclosure.
Figure 50:
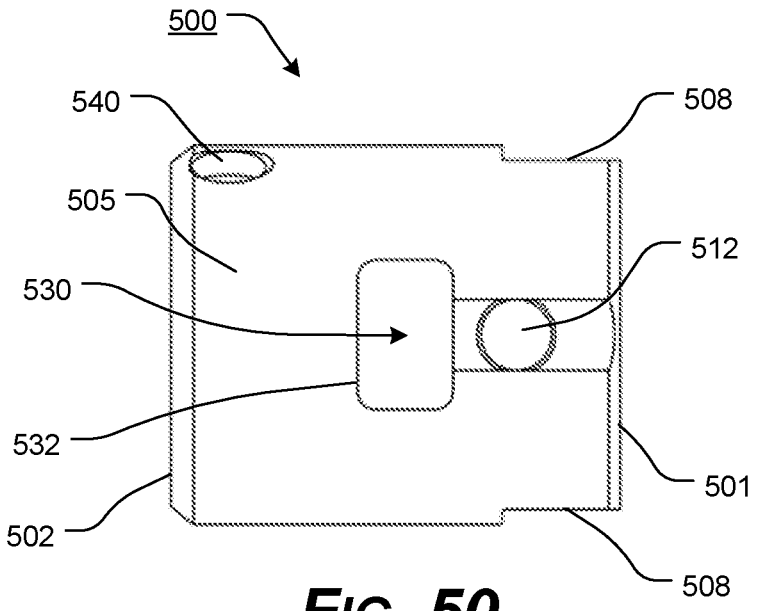
FIG. 50 shows a left side view of an exemplary embodiment of a collar, according to the present disclosure.
Figure 51:
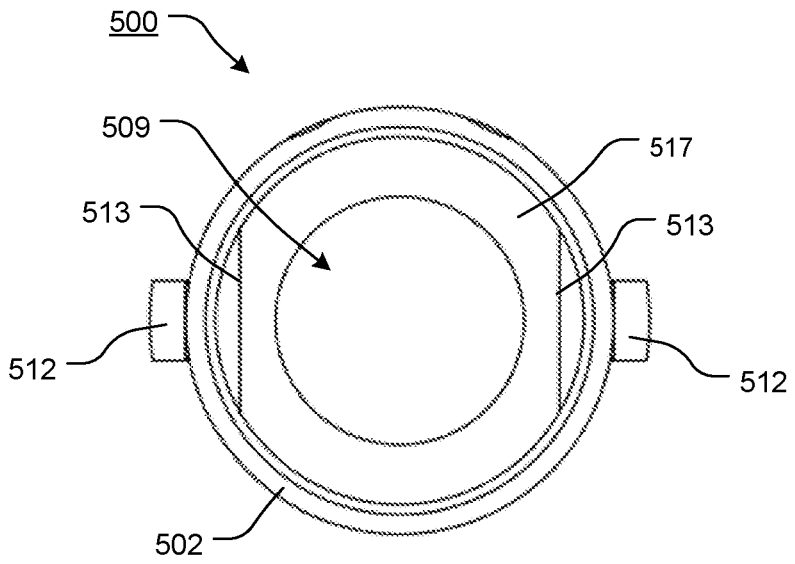
FIG. 51 shows a front view of an exemplary embodiment of a collar, according to the present disclosure.
Figure 52:
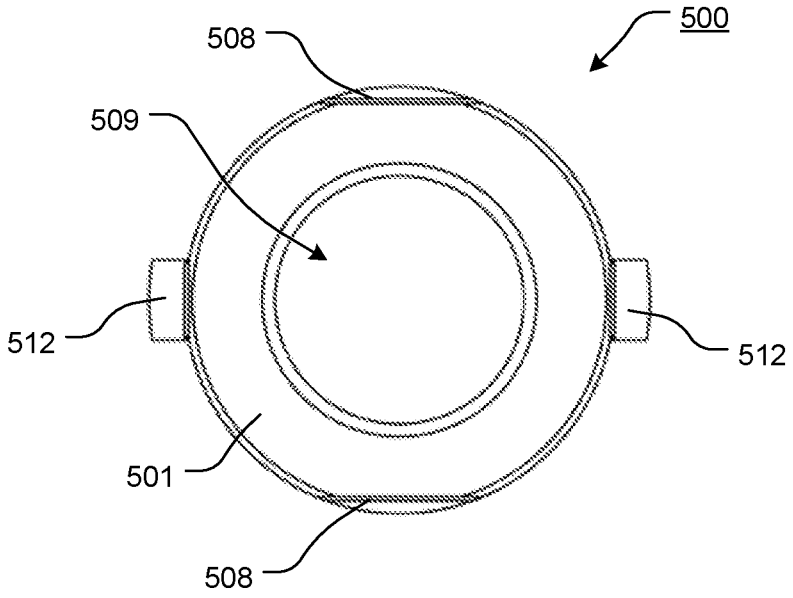
FIG. 52 shows a front view of an exemplary embodiment of a collar, according to the present disclosure.
Figure 53:
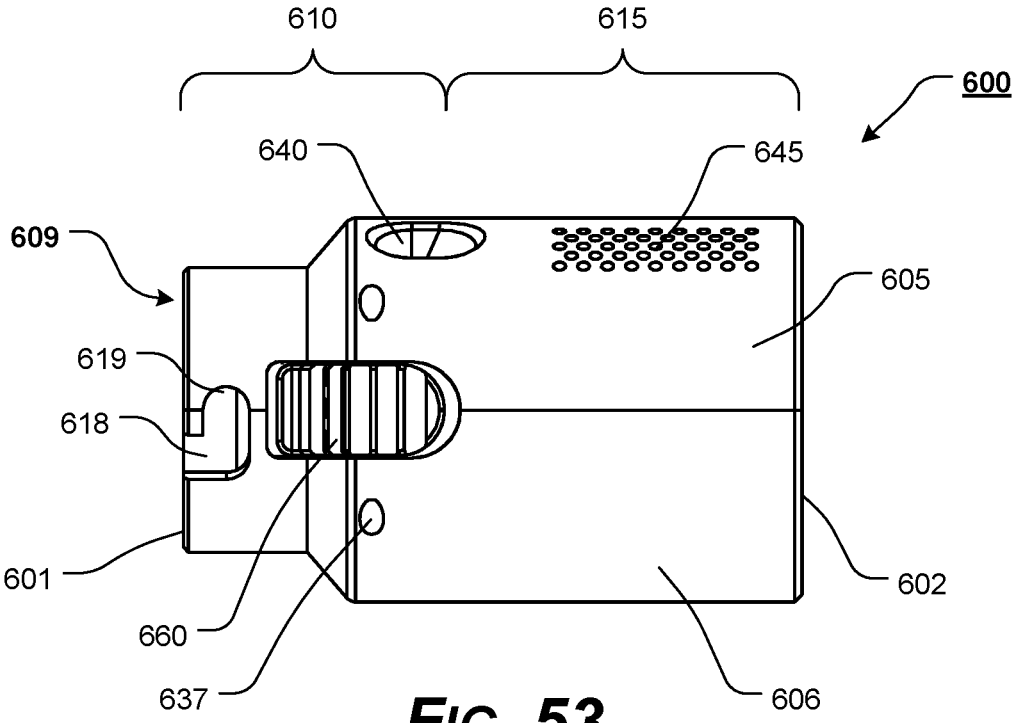
FIG. 53 shows a right side view of an exemplary embodiment of a blast shield, according to the present disclosure.
Figure 54:
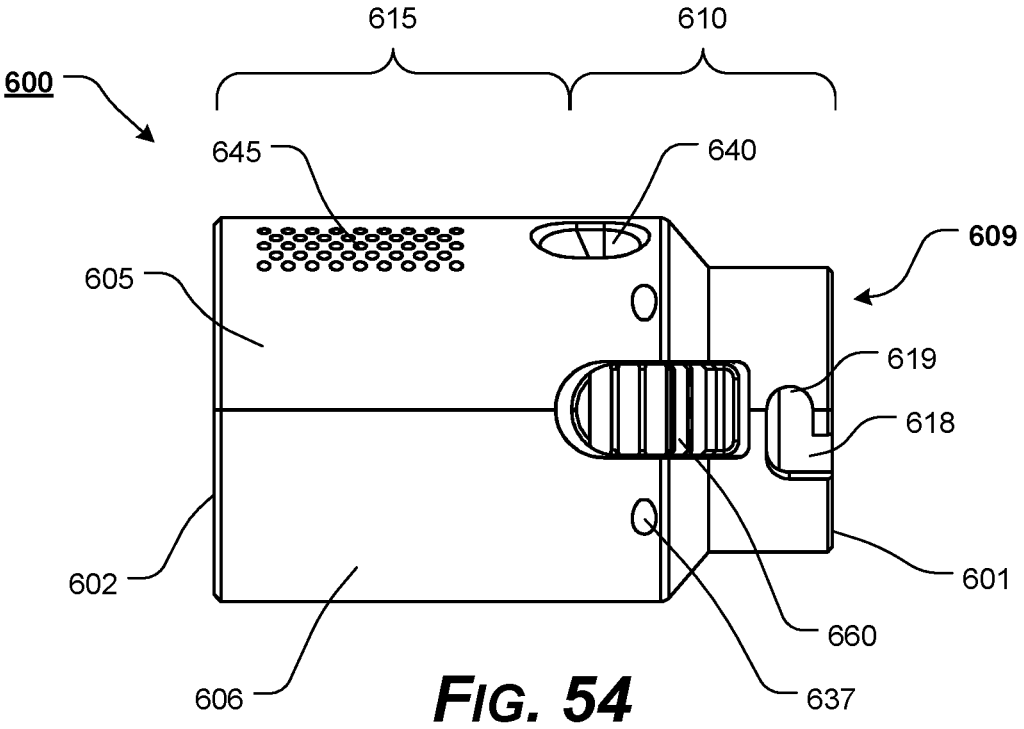
FIG. 54 shows a left side view of an exemplary embodiment of a blast shield, according to the present disclosure.
Figure 55:
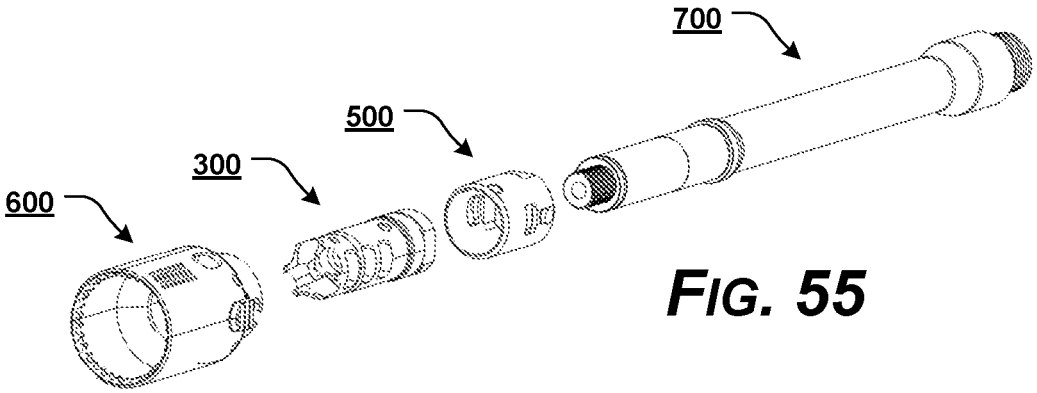
FIG. 55 shows a front, left perspective exploded view of an exemplary embodiment of a collar, muzzle device, and blast shield being aligned with an exemplary barrel, according to the present disclosure.
Figure 56:
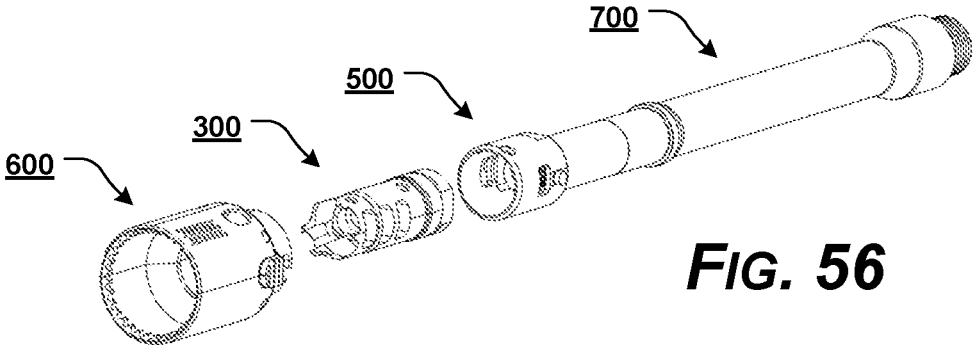
FIG. 56 shows a front, left perspective partially exploded view of an exemplary embodiment of a collar, muzzle device, and blast shield being aligned with and attached or coupled to an exemplary barrel, according to the present disclosure.
Figure 57:
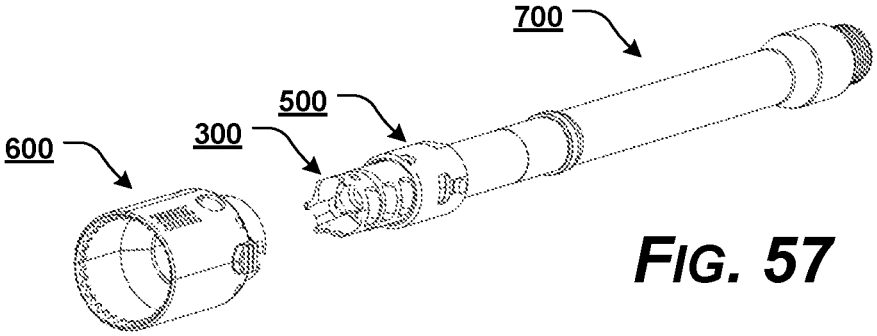
FIG. 57 shows a front, left perspective partially exploded view of an exemplary embodiment of a collar, muzzle device, and blast shield being aligned with and attached or coupled to an exemplary barrel, according to the present disclosure.
Figure 58:
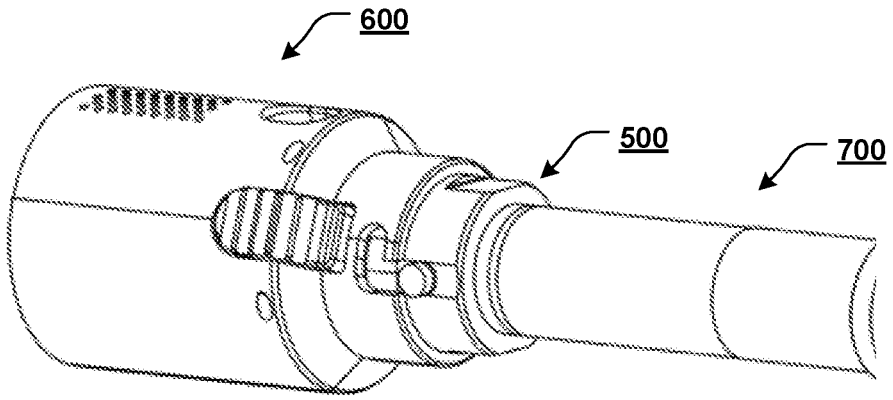
FIG. 58 shows a rear, left perspective view of an exemplary embodiment of a blast shield being aligned with and attached or coupled to a collar, according to the present disclosure.

As illustrated most clearly in FIGS. 36 and 44, the primary blast shield venting apertures 240 are formed at an acute angle θ1 relative to one another. Each primary blast shield venting aperture 240 is formed at the same angle θ1 as the angles at which the collar venting apertures 140 and the muzzle brake venting apertures 340 are formed.

As illustrated, the primary blast shield venting apertures 240 have substantially parallel sidewalls and have a substantially cylindrical or oblong shape. Alternatively, one or more of the blast shield venting apertures may be tapered or reversed tapered and may take on other shapes. Thus, it should be understood that the overall angle, diameter, size, and shape of each primary blast shield venting aperture 240 is a design choice based upon the desired functionality (i.e. fluid capacity, fluid flow characteristics, etc.) of the primary blast shield 200.

In various exemplary, nonlimiting embodiments, the blast shield 200 further includes a plurality of secondary venting apertures 245 formed through the external cup sidewalls 206 of the cup portion 215. The secondary venting apertures 245, if included, allow fluid communication between the interior cavity of the blast cup portion 215 and the outside surface of the blast shield 200. The secondary venting apertures 245 may optionally be formed on the upper portion of the cup portion 215, such that propellant gases are expelled upward, helping to counteract muzzle rise during a firing cycle.

The blast shield 200 comprises a retention means that is capable of retaining the collar 100 securely within the collar receiving recess 212 and restricting withdrawal of the collar 100 from the collar receiving recess 212 of the blast shield 200 while permitting a quick release of the blast shield 200 from the collar 100 when the user requires. The retention means comprises one or more levers 260 pivotable between and engaged position and a disengaged position.

Each lever 260 comprises a first side 261 facing generally outward from the blast shield 200 and a second side 262 facing generally toward the blast shield 200. The lever 260 comprises at least some of a depressible portion 268 and an engagement portion 263.

In various exemplary embodiments, one or more portions of the first side 261 of at least the depressible portion 268 includes a textured portion. In this manner, at least a portion of the depressible portion 268 may be distinguished tactilely from other portions of the lever 260 or the blast shield 200.

In various exemplary, non-limiting embodiments, the lever 260 is pivotally attached or coupled to the external cup sidewall 206, within a lever 260 recess 235. The lever 260 is pivotably attached or coupled approximately between the depressible portion 268 and the engagement portion 263 of the lever 260, via a fulcrum or pivot pin 239 positioned through a lever pivot pin aperture 237 of the blast shield 200 and a pivot pin aperture 267 of the lever 260. In various exemplary embodiments, the lever pivot pin aperture 237 is formed substantially parallel to a longitudinal axis $A_L$ of the blast shield 200, substantially perpendicular to a longitudinal axis $A_L$ of the blast shield 200, at a substantially acute angle relative to a longitudinal axis $A_L$ of the blast shield 200, or at a substantially obtuse angle relative to a longitudinal axis $A_L$ of the blast shield 200. Thus, the lever pivot pin aperture 237 may be formed at any angle relative to a longitudinal axis $A_L$ of the blast shield 200.

The lever 260 is pivotable between an engaged position for securing the collar 100 within the collar receiving recess 212 of the blast shield 200 and a disengaged position that allows removal of the collar 100 from the collar receiving recess 212 of the blast shield 200.

In various exemplary embodiments, the lever 260 is biased to a releasably engaged position by, for example, a spring biasing element 269. It should be appreciated that any suitable biasing means, element, or mechanism may be used to form the spring biasing element 269. For example, in various illustrative, non-limiting embodiments of the present disclosure, the spring biasing element 269 may comprise a portion of spring steel, a helical spring, a compression coil spring, a cylindrical coil spring, a conical coil spring, a tension coil spring, a leaf spring, a V-spring, a cantilever spring, a spring washer, a flexible extension of the lever 260 or the external cup sidewall 206, a stretched or tensioned material, such as, for example, a rubber band, a resiliently compressible portion of material, or any other element, material, or mechanism usable to bias the lever 260 to the engaged position.

The engagement portion 263 of the lever 260 includes a locking projection 264, formed on the second side 262 of the engagement portion 263. In certain exemplary embodiments, the locking projection 264 includes a locking shoulder 265 that extends substantially perpendicularly from the second side 262 of the engagement portion 263.

In various exemplary, nonlimiting embodiments, the locking projection 264 also includes a ramp surface 266. Alternatively, the locking projection 264 may terminate in a radiused or non-radiused manner.

When the lever 260 is in the engaged position, the locking projection 264 protrudes through a lever recess aperture 230 formed in the lever recess 235 and into at least a portion of the collar receiving recess 212. In this manner, the locking projection 264 may extend inside the collar receiving recess 212 and inside the locking notch 130 of a collar 100 that is appropriately received within the collar receiving recess 212 and, thereby, retain the collar 100 within the collar receiving recess 212 of the blast shield 200.

In various exemplary embodiments, the locking projection 264 protrudes into the collar receiving recess 212 a distance that is less than the width of the collar sidewall 106. Alternatively, the locking projection 264 may protrude into the collar receiving recess 212 a distance that is equal to or greater than the width of the collar sidewall 106.

In addition, when the lever 260 is in the engaged position and is retaining a collar 100 within the collar receiving recess 212, the clearance between the sidewall 132 of the locking notch 130 and locking shoulder 265 of the locking projection 264 should be such that there is room for the slight arc or plunger-type movement of the locking projection 264 when the depressible portion 268 is depressed and the locking protrusion is withdrawn from the locking notch 130.

During attachment or coupling of the blast shield 200 to the collar 100, as a user begins to attach or couple the blast shield 200 to the collar 100, the collar 100 is aligned with the collar receiving recess 212 and the blast shield 200 is urged over the collar 100.

As the collar 100 is inserted further into the collar receiving recess 212, the outer surface of the collar 100 will contact the ramp surfaces 266 of the locking projections 264. The shape of the ramp surfaces 266 allows the locking projections 264 to ride along the surface of the collar 100 and displace the locking projections 264 of the levers 260. As the locking projections 264 ride along the surface of the collar 100, the bias of the levers 260 is overcome and the levers 260 are pivoted towards the disengaged position and the collar 100 is permitted to be seated in the collar receiving recess 212 of the blast shield 200.

As the collar 100 is further seated into the collar receiving recess 212 of the blast shield 200, the collar 100 continues to displace the locking projections 264 and the levers 260 continue to pivot until the locking projections 264 pass a point of contact with the sidewalls 132 and the locking shoulders 265 pass the sidewalls 132 of the locking notch 130. When the locking shoulders 265 pass the sidewalls 132 of the locking notch 130, the lever 260 is biased, via the spring biasing element 269, to pivot back to the engaged position and the locking projections 264 are positioned at least partially within the locking notch 130.

Thus, the collar 100 is secured in the collar receiving recess 212 of the blast shield 200 by interaction of the locking projections 264 and the locking notches 130 (and, more particularly, the locking shoulders 265 and the sidewalls 132 of the locking notch 130) blocking removal of the collar 100. While the collar 100 is appropriately seated in the collar receiving recess 212 of the blast shield 200 with the lever 260 biased to the engaged position, removal of the collar 100 is not permitted, as the locking projections 264 do not allow the collar 100 to pass by. When the collar 100 is secured in place, removal force applied to the collar 100 will not remove the collar 100 from the blast shield 200 unless the depressible portions 268 are pivoted to the disengaged position and the locking projections 264 are withdrawn from locking notches 130.

When the blast shield 200 is appropriately secured to the collar 100, as illustrated, for example, in FIGS. 25-36, the collar venting apertures 140 are appropriately aligned with the primary blast shield venting apertures 240 so as to allow fluid communication between the central collar aperture 109, via the aligned collar venting apertures 140 and the primary blast shield venting apertures 240, to the exterior of the blast shield 200. Thus, blast propellant gases are able to exit from the central collar aperture 109, through the aligned collar venting apertures 140 and primary blast shield venting apertures 240, to the exterior of the blast shield 200.

In order to release and blast shield 200 from the collar 100, the user depresses the depressible portions 268 of the levers 260, pivoting the depressible portions 268 towards the collar receiving recess 212. As the depressible portions 268 of the levers 260 are depressed, the bias of the levers 260 is overcome, the levers 260 are pivoted towards the disengaged position, and the locking projections 264 of the engagement portions 263 are at least partially withdrawn from the locking notches 130.

When the depressible portion 268 has been depressed sufficiently, such that the locking projections 264 of the locking projections 264 are sufficiently withdrawn from the locking notches 130, the collar 100 will no longer be blocked by the locking projections 264, and the blast shield 200 can be slidably removed from the collar 100.

It should be appreciated that while the blast mitigation device is shown and described as including two juxtaposed levers 260 and two corresponding locking notches 130 the present disclosure is not so limited. Thus, the present blast mitigation device may include only one lever 260 and one corresponding locking notch 130 or a plurality of locking levers 260 and a plurality of corresponding locking notches 130. Regardless of the number of levers 260 and corresponding locking notches 130, each lever 260 and locking notch 130 operates in a similar manner.

FIGS. 37-40 show an embodiment of a muzzle device or muzzle brake 300 that may optionally be used in conjunction with the currently disclosed blast mitigation device. The muzzle device or muzzle brake 300 illustrated in FIGS. 37-40 (and also in FIGS. 41A-44) is an exemplary embodiment of the muzzle brake described in U.S. patent application Ser. No. 14/499,993, filed Sep. 29, 2014, the disclosure of which is incorporated herein in its entirety by reference. While the blast mitigation device of the current disclosure is illustrated as being used in conjunction with this exemplary muzzle device or muzzle brake 300, it should be appreciated that the blast mitigation device may be utilized in conjunction with other muzzle brake, flash suppressors, or muzzle devices.

In various exemplary, nonlimiting embodiments, the muzzle device or muzzle brake 300 includes one or more baffle walls 335 defining one or more baffle ports 330.

In various exemplary, nonlimiting embodiments, the muzzle brake 300 further comprises at least three flutes 360 extending from a terminal end, towards an initial end. In certain embodiments, the flutes 360 are defined by tapered sidewalls 365 extending outward from the central borehole aperture, towards the terminal end. The flutes 360 provide for a more complete burn of any propellant exiting the central borehole aperture (and reduce any associated muzzle flash) and the breakup and misdirection of the remaining propellant gases that exit through the terminal end of the muzzle brake 300.

In various exemplary, nonlimiting embodiments, the muzzle brake 300 further comprises a plurality of circular or radiused notches 363 extending from the terminal end towards the initial end.

During initial installation of the blast mitigation device, the collar 100 is appropriately positioned about at least a portion of the muzzle device or muzzle brake 305 of the muzzle device or muzzle brake 300. This is accomplished by positioning at least a portion of the muzzle device or muzzle brake 300 within the central collar aperture 109. Once appropriately positioned, mounting screws 170 are positioned within the mounting screw apertures 125 and appropriately tightened to secure the collar 100 to the muzzle device or muzzle brake 300. It should be appreciated that the collar 100 can be attached or coupled to the muzzle device or muzzle brake 300 while the muzzle device or muzzle brake 300 is attached or coupled to an exemplary barrel 700 of a firearm, if desired. Alternatively, the collar 100 can be attached or coupled to the muzzle device or muzzle brake 300 while the muzzle device or muzzle brake 300 is attached or separate from the barrel 700 of a firearm.

Once the collar 100 has been appropriately attached or coupled to the muzzle device or muzzle brake 300, the blast shield 200 may be selectively attached to or removed from the collar 100 (and muzzle device or muzzle brake 300), as described herein.

Figure 42:
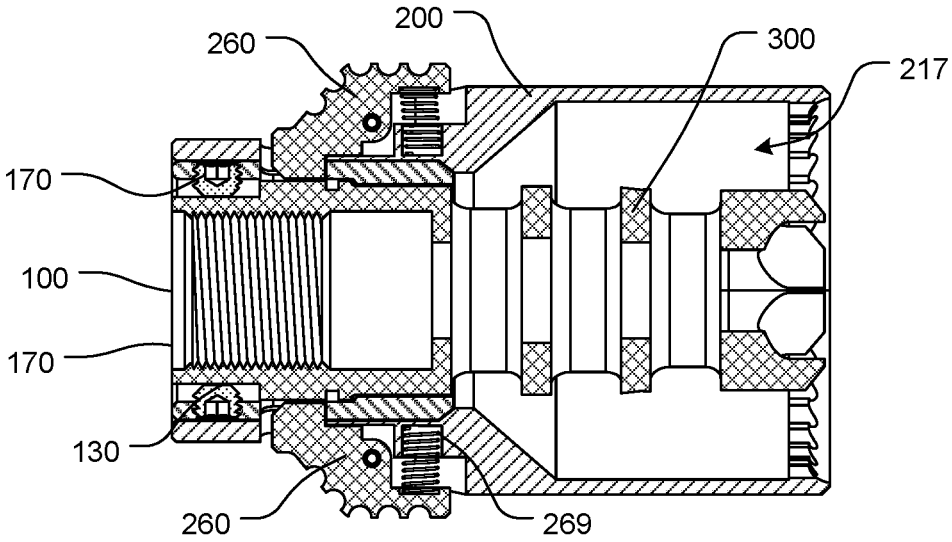
FIG. 42 shows a top cross-sectional view of an exemplary embodiment of a flash suppressor or muzzle device having a blast mitigation device attached or coupled thereto, according to the present disclosure.
Figure 43:
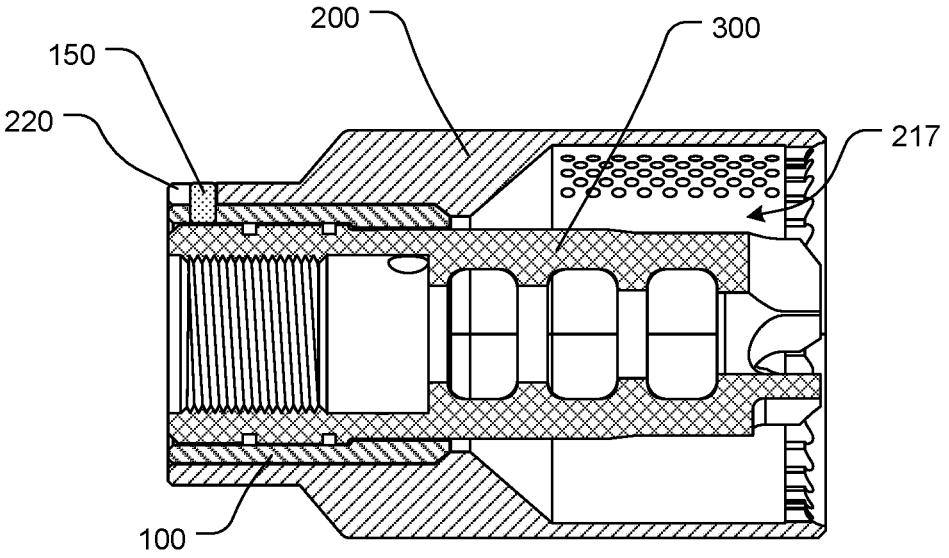
FIG. 43 shows a side cross-sectional view of an exemplary embodiment of a flash suppressor or muzzle device having a blast mitigation device attached or coupled thereto, according to the present disclosure.

When the blast shield 200 is appropriately secured to the collar 100, as illustrated in FIGS. 42-44, the muzzle brake venting apertures 340 are appropriately aligned with the collar venting apertures 140 and the collar venting apertures 140 are appropriately aligned with the primary blast shield venting apertures 240. In this manner, the central bore aperture of the muzzle device or muzzle brake 300 is in fluid communication with the exterior of the blast shield 200, via alignment of the muzzle brake venting apertures 340, the collar venting apertures 140, and the primary blast shield venting apertures 240. Thus, during the firing cycle, blast propellant gases are able to exit from the muzzle brake 300, through the aligned muzzle brake venting apertures 340, collar venting apertures 140, and primary blast shield venting apertures 240, to the exterior of the blast shield 200.

In addition, the baffle apertures 345 are appropriately aligned proximate the secondary venting apertures 245.

While the collar 100 has been illustrated and described as comprising a separate component that is attached or coupled to the muzzle device or muzzle brake 300, the present disclosure is not limited to such an exemplary embodiment. In certain exemplary embodiments, as illustrated, for example, in FIG. 41B, the locking notches 130' and collar venting apertures 140 of the collar 100 are formed as integral components of a muzzle device or muzzle brake 300'. Therefore, these features and elements of the collar 100 are present in the muzzle device or muzzle brake 300 and a separately attached or coupled collar 100 is not necessary.

Figure 41A:
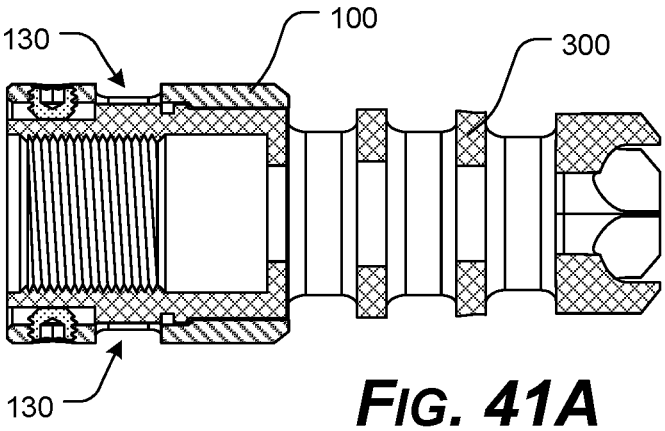
FIG. 41A shows a top cross-sectional view of an exemplary embodiment of a flash suppressor or muzzle device having a collar attached or coupled thereto, according to the present disclosure.
Figure 41B:
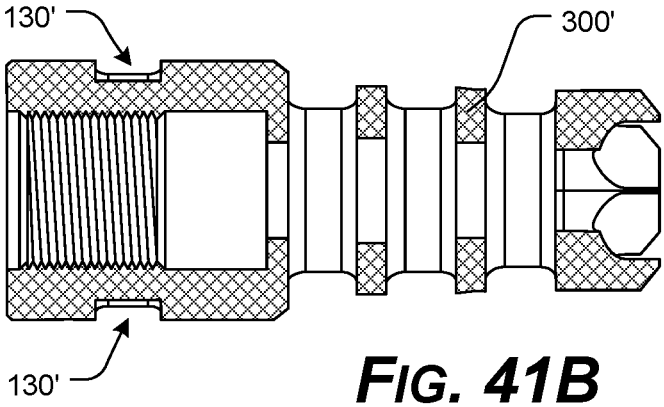
FIG. 41B shows a top cross-sectional view of an exemplary embodiment of a flash suppressor or muzzle device having a collar formed integral thereto, according to the present disclosure.

In these exemplary embodiments, the separate collar 100 and muzzle brake 300, as illustrated, for example, in FIG. 41A, would form an integral unit and the mounting apertures 125 and mounting screws 170 would not be necessary or included.

It should also be appreciated that a more detailed explanation of the muzzle device or muzzle brake 300, further considerations for selecting an appropriate muzzle device or muzzle brake 300, instructions regarding the use and operation of the muzzle device and/or blast mitigation device, and certain other items and/or techniques necessary for the implementation and/or operation of the blast mitigation device are not provided herein because such information will be understood by one of ordinary skill in the art. Therefore, it is believed that the level of description provided herein is sufficient to enable one of ordinary skill in the art to understand and practice the present disclosure, as described.

FIGS. 45-61 illustrate various exemplary components of an exemplary embodiment of a collar 500 and a blast shield 600, according to the presently disclosed systems, methods, and/or apparatuses. As shown in FIGS. 45-61, the collar 500 comprises at least some of a collar body 505, which extends along a longitudinal axis $A_L$ from a first end 501 to a second end 502, an attachment portion, an extension portion, a substantially cylindrical borehole or central collar aperture 509, one or more interior sidewalls 507, one or more locking notches 530 defined by sidewalls 532, and/or one or more collar venting apertures 540. It should be understood that each of these elements corresponds to and operates similarly to the collar 100, the collar body 105, which extends along a longitudinal axis $A_L$ from the first end 101 to the second end 102, the attachment portion 110, the extension portion 115, the substantially cylindrical borehole or central collar aperture 109, the one or more interior sidewalls 107, the one or more locking notches 130 defined by the sidewalls 132, and the one or more collar venting apertures 140, as described above with reference to the collar 100 of FIGS. 1-44.

Similarly, the blast shield 600 comprises at least some of a body portion or blast shield body 605 that extends along a longitudinal axis $A_L$ from an open first end 601 to an open second end 602, one or more external cup sidewalls 606, a central borehole 609, a blast shield attachment portion 610, a blast cup portion 615, one or more internal cup sidewalls 607, one or more internal cup bottom walls 608, an internal cavity 617, a collar receiving recess 612, a plurality of relief cuts 625 defining a plurality of blast shield teeth 627, blast shield levers 660 (each blast shield lever 660 comprising a first side 661, a second side 662, a depressible portion 668, and an engagement portion 663), a lever recess aperture 630, a lever recess 635, a lever pivot pin aperture 637, a fulcrum or pivot pin 639, one or more primary blast shield venting apertures 640, a plurality of optional secondary venting apertures 645, a pivot pin aperture 667, a spring biasing element 669, a locking projection 664, a locking shoulder 665, and/or an optional ramp surface 666. It should be understood that each of these elements corresponds to and operates similarly to the blast shield 200, the body portion or blast shield body 205 that extends along the longitudinal axis $A_L$ from the open first end 201 to the open second end 202, the one or more external cup sidewalls 206, the central borehole 209, the blast shield attachment portion 210, the blast cup portion 215, the one or more internal cup sidewalls 207, the one or more internal cup bottom walls 208, the internal cavity 217, the collar receiving recess 212, the plurality of relief cuts 225 defining the plurality of blast shield teeth 227, the blast shield levers 260 (each blast shield lever 260 comprising the first side 261, the second side 262, the depressible portion 268, and the engagement portion 263), the lever recess aperture 230, the lever recess 235, the lever pivot pin aperture 237, the fulcrum or pivot pin 239, the one or more primary blast shield venting apertures 240, the plurality of optional secondary venting apertures 245, the pivot pin aperture 267, the spring biasing element 269, the locking projection 264, the locking shoulder 265, and the optional ramp surface 266, as described above with reference to the blast shield 200 of FIGS. 10-44.

However, as shown in FIGS. 45-61, the collar 500 further comprises one or more engagement pins extending from the collar body 505. As illustrated, the collar 500 comprises two engagement pins extending from the collar body 505 positioned between the first end 501 and the locking notches 530. It should be appreciated that the number and placement of the engagement pins is a design choice based upon the desired functionality of the engagement pins and the collar 500.

The engagement pins extend from the collar body 505 a sufficient distance so as to interact with and/or engage the engagement groove 618 and engagement stop 619 of the blast shield 600, as described herein.

The substantially cylindrical borehole or central collar aperture 509 includes an interior shoulder 517 defined proximate the first end 501 of the collar 500. The interior shoulder 517 extends into the central collar aperture 509, to reduce the overall diameter of the central collar aperture 509.

One or more interior flats 513 extend from the one or more interior sidewalls 507. The one or more interior flats 513 are formed so as to correspond to one or more exterior flats 308 formed in the muzzle brake 300. It should be appreciated that the size and shape of the interior flats 513 of the collar 500 are a design choice and are formed so as to substantially correspond to and interact with the exterior flats 308 formed in the muzzle brake 300. The interior flats 513 of the collar 500 and the exterior flats 308 of the muzzle brake 300 are formed such that when at least a portion of the muzzle brake 300 is positioned within the central collar aperture 509 of the collar 500, at least one or more portions of a surface of the interior flats 513 of the collar 500 interact with at least one or more portions of a surface of the exterior flats 308 of the muzzle brake 300 to maintain a desired rotational orientation of the collar 500 relative to the muzzle brake 300.

The degree of frictional engagement or spacing between the interior flats 513 of the collar 500 and the exterior flats 308 of the muzzle brake 300 are a design choice based upon the desired amount of potential rotational movement of the collar 500 relative to the muzzle brake 300, when attached, coupled, or installed on an exemplary barrel 700, as illustrated in FIGS. 57-61.

It should be appreciated that while the interior flats 513 of the collar 500 and the exterior flats 308 of the muzzle brake 300 are shown and described as being substantially parallel, substantially flat, or planar surfaces, this is merely illustrative and not restrictive. Thus, it should be appreciated that the number, size, and/or shape of the corresponding interior flats 513 of the collar 500 and the exterior flats 308 of the muzzle brake 300 is a design choice based upon the desired degree of interlocking engagement between the interior flats 513 of the collar 500 and the exterior flats 308 of the muzzle brake 300.

In certain exemplary, nonlimiting embodiments, exterior flats 508 may optionally be provided on the collar body 505. If included, the exterior flats 508 may optionally be provided on at least two opposing side portions of the collar body 505, proximate the first end 501. The exterior flats 508 may provide parallel surfaces for a wrench or other installation device to grip the collar 500 to be used to aid in the installation of the collar 500 and/or the muzzle brake 300.

As illustrated most clearly in FIGS. 53-61, the blast shield 600 further comprises at least one engagement groove 618 formed in at least a portion of the blast shield attachment portion 610, extending from the open first end 601. The engagement groove 618 or grooves 618 extend from the open first end 601 to engagement stop 619. In various exemplary embodiments, each engagement groove 618 comprises a substantially "L" shaped engagement groove 618. Alternatively, each engagement groove 618 may comprise a substantially "C", substantially spiral, substantially linear, or angular groove.

In various exemplary embodiments, the number of engagement grooves 618 corresponds to the number of engagement pins 512 extending from the collar 500. Alternatively, the number of engagement grooves 618 may be greater than the number of engagement pins 512 extending from the collar 500. In various exemplary embodiments, each engagement pin 512 extends radially from the collar 500.

Each engagement groove 618 is sized and shaped so as to accept at least a portion of an engagement pin 512 within the engagement. In various exemplary embodiments, as the blast shield 600 is attached or coupled to the collar 500, as described herein, each engagement pin 512 is aligned with and positioned within an appropriate engagement groove 618. As the blast shield 600 is further attached or coupled to the collar 500, the interaction between each engagement pin 512 and each engagement groove 618 maintains a desired alignment between the blast shield 600 and the collar 500. When the blast shield 600 is in a desired position relative to the collar 500, each engagement pin 512 is positioned at least partially within each corresponding engagement stop 619.

The length of each engagement groove 618 and each engagement stop 619 may be altered to dictate the amount of longitudinal distance (substantially parallel to the longitudinal axis) and the rotational distance (rotation perpendicular to the longitudinal axis) that the blast shield 600 travels relative to the collar 500 before being secured to the collar 500.

When each engagement pin 512 is positioned at least partially within each corresponding engagement stop 619, the collar 500 may be secured in the collar receiving recess 612 of the blast shield 600 by interaction of the locking projections 664 and the locking notches 530 (and, more particularly, the locking shoulders 665 and the sidewalls 532 of the locking notch 530) blocking removal of the collar 500.

It should be appreciated that while the collar 500 is shown and described as including two juxtaposed engagement pins 512 and the blast shield 600 is shown and described as including two corresponding engagement grooves 618, the present disclosure is not so limited. Thus, the presently disclosed collar 500 may include only one engagement pin 512 and the blast shield 600 may include only one corresponding engagement groove 618 or the presently disclosed collar 500 may include a plurality of engagement pins 512 and the blast shield 600 may include a plurality of corresponding engagement grooves 618. Regardless of the number of engagement pins 512 and corresponding engagement grooves 618, each corresponding engagement pin 512 and engagement groove 618 operates in a similar manner.

During attachment or coupling of the collar 500 to the muzzle device 300 and a firearm barrel 700, as illustrated in FIGS. 55-61, the collar 500 is positioned such that at least a portion of the externally threaded portion of the barrel 700 is positioned within the central collar aperture 509. The muzzle device 300 is also appropriately positioned within at least a portion of the central collar aperture 509. The muzzle device 300 is threadedly secured to the firearm barrel 700 via interaction of the externally threaded portion of the barrel 700 and the internally threaded portion of the muzzle device 300. When the muzzle device is threadedly secured to the firearm barrel 700, a first end 301 of the muzzle device 300 contacts at least a portion of the interior surface of the interior shoulder 517 of the collar 500 and at least one or more portions of a surface of the interior flats 513 of the collar 500 interact with at least one or more portions of a surface of the exterior flats 308 of the muzzle brake 300 to maintain a desired rotational orientation of the collar 500 relative to the muzzle brake 300.

During attachment or coupling of the blast shield 600 to the collar 500, as a user begins to attach or couple the blast shield 600 to the collar 500, the collar 500 is aligned with the collar receiving recess 612 and the blast shield 600 is urged over the collar 500.

As the collar 500 is inserted further into the collar receiving recess 612, the engagement pins 512 are aligned with the engagement grooves 618 and the collar 500 is further inserted into the collar receiving recess 612, following the pattern dictated by the interaction of the engagement pins 512 and the engagement grooves 618. In certain exemplary embodiments, this initially requires further lateral insertion of the collar 500 into the collar receiving recess 612, followed by rotation of the blast shield 600 relative to the collar 500.

As the blast shield 600 is attached or coupled to the collar 500 such that the engagement pins 512 become appropriately positioned relative to the engagement stops 619, the outer surface of the collar 500 will contact the ramp surfaces 666 of the locking projections 664. The shape of the ramp surfaces 666 allows the locking projections 664 to ride along the surface of the collar 500 and displace the locking projections 664 of the levers 660. As the locking projections 664 ride along the surface of the collar 500, the bias of the levers 660 is overcome and the levers 660 are pivoted towards the disengaged position and the collar 500 is permitted to be seated in the collar receiving recess 612 of the blast shield 600.

As the collar 500 is further seated into the collar receiving recess 612 of the blast shield 600, the collar 500 continues to displace the locking projections 664 and the levers 660 continue to pivot until the locking projections 664 pass a point of contact with the sidewalls 532 and the locking shoulders 665 pass the sidewalls 532 of the locking notch 530. When the locking shoulders 665 pass the sidewalls 532 of the locking notch 530, the engagement pins 512 are positioned at the engagement stops 619 and the lever 660 is biased, via the spring biasing element 669, to pivot back to the engaged position and the locking projections 664 are positioned at least partially within the locking notch 530.

Thus, the collar 500 is secured in the collar receiving recess 612 of the blast shield 600 by interaction of the locking projections 664 and the locking notches 530 (and, more particularly, the locking shoulders 665 and the sidewalls 532 of the locking notch 530) blocking removal of the collar 500 and by engagement of the engagement pins 512 and the engagement stops 619.

While the collar 500 is appropriately seated in the collar receiving recess 612 of the blast shield 600 with the lever 660 biased to the engaged position, removal of the collar 500 is not permitted, as the locking projections 664 do not allow the collar 500 to pass by. When the collar 500 is secured in place, removal force applied to the collar 500 will not remove the collar 500 from the blast shield 600 unless the depressible portions 668 are pivoted to the disengaged position and the locking projections 664 are withdrawn from locking notches 530.

Figure 59:
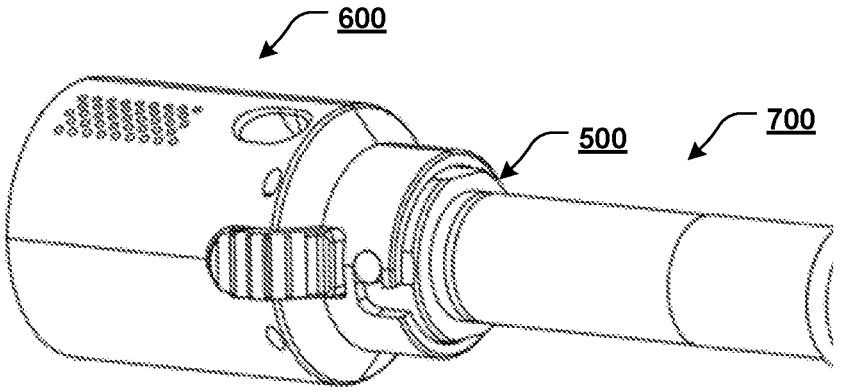
FIG. 59 shows a rear, left perspective view of an exemplary embodiment of a blast shield being aligned with and attached or coupled to a collar, according to the present disclosure.
Figure 60:
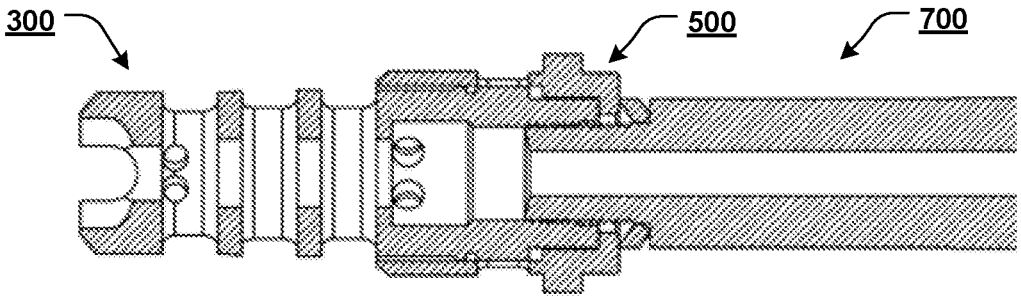
FIG. 60 shows a bottom cross-sectional view of an exemplary embodiment of a collar and muzzle device attached or coupled to an exemplary barrel, according to the present disclosure.
Figure 61:
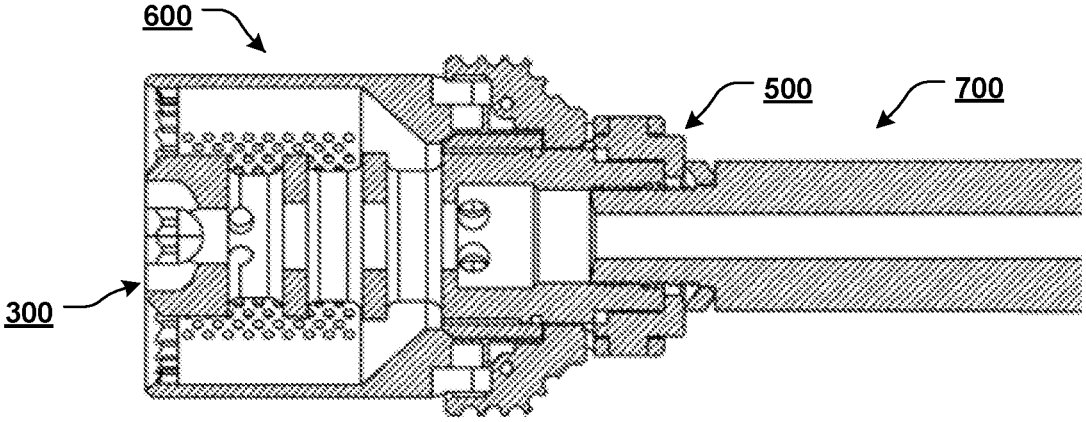
FIG. 61 shows a bottom cross-sectional view of an exemplary embodiment of a collar, muzzle device, and blast shield attached or coupled to an exemplary barrel, according to the present disclosure.

When the blast shield 600 is appropriately secured to the collar 500, as illustrated, for example, in FIGS. 59 and 61, the collar venting apertures 540 are appropriately aligned with the primary blast shield venting apertures 640 so as to allow fluid communication between the central collar aperture 509, via the aligned collar venting apertures 540 and the primary blast shield venting apertures 640, to the exterior of the blast shield 600. Thus, blast propellant gases are able to exit from the central collar aperture 509, through the aligned collar venting apertures 540 and primary blast shield venting apertures 640, to the exterior of the blast shield 600.

In order to release and blast shield 600 from the collar 500, the user depresses the depressible portions 668 of the levers 660, pivoting the depressible portions 668 towards the collar receiving recess 612. As the depressible portions 668 of the levers 660 are depressed, the bias of the levers 660 is overcome, the levers 660 are pivoted towards the disengaged position, and the locking projections 664 of the engagement portions 663 are at least partially withdrawn from the locking notches 530.

When the depressible portion 668 has been depressed sufficiently, such that the locking projections 664 of the locking projections 664 are sufficiently withdrawn from the locking notches 530, the collar 500 will no longer be blocked by the locking projections 664, and the blast shield 600 can be slidably removed from the collar 500, as dictated by the interaction of the engagement pins 512 and the engagement grooves 618.

While the present disclosure has been described in conjunction with the exemplary embodiments outlined above, the foregoing description of exemplary embodiments of the present disclosure, as set forth above, are intended to be illustrative, not limiting and the fundamental disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which this disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "the", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A blast shield attachment system, comprising:

a collar having one or more locking notches formed at least partially therethrough and one or more engagement pins extending therefrom; and a blast shield having a collar receiving recess, wherein one or more engagement grooves extend from a first end of said blast shield, wherein one or more levers are pivotably attached or coupled to said blast shield, wherein each lever is pivotable for releasable engagement with a corresponding one of said locking notches of said collar, and wherein when at least a portion of said collar is appropriately received within said collar receiving recess, at least one of said one or more engagement pins is aligned within at least one of said one or more engagement grooves and each said lever is releasably engaged with a corresponding one of said locking notches of said collar.

2. The blast shield attachment system of claim 1, wherein said one or more locking notches are formed through a collar body of said collar.

3. The blast shield attachment system of claim 1, wherein said collar includes a central collar aperture formed therethrough.

4. The blast shield attachment system of claim 1, wherein each of said engagement grooves comprises a substantially "L" shaped engagement groove.

5. The blast shield attachment system of claim 1, wherein said collar further comprises one or more interior flats extending into at least a portion of a central collar aperture.

6. The blast shield attachment system of claim 5, wherein each of said one or more interior flats is formed so as to engage a flat portion formed in an exterior surface of a muzzle device.

7. The blast shield attachment system of claim 1, wherein a muzzle device is at least partially received within said central collar aperture.

8. The blast shield attachment system of claim 7, wherein said muzzle device attaches or couples said collar to a firearm barrel.

9. The blast shield attachment system of claim 1, wherein said collar includes one or more collar venting apertures and said blast shield includes one or more blast shield venting apertures, such that when said collar is attached or coupled to said blast shield, each said engagement pin is positioned proximate an engagement stop of each of said one or more engagement grooves, and each lever is releasably engaged with a corresponding one of said locking notches of said collar, each said collar venting aperture is aligned with at least one of said one or more blast shield venting apertures.

10. The blast shield attachment system of claim 1, wherein each said engagement pin extends radially from said collar.

11. A blast shield attachment system, comprising:

a collar having one or more locking notches formed at least partially therethrough and one or more engagement pins extending therefrom; and a blast shield having a collar receiving recess, wherein one or more substantially "L" shaped engagement grooves extend from a first end of said blast shield to an engagement stop, wherein one or more levers are pivotably attached or coupled to said blast shield, wherein each lever is pivotable for releasable engagement with a corresponding one of said locking notches of said collar, and wherein when at least a portion of said collar is appropriately received within said collar receiving recess and each said engagement pin is positioned proximate said engagement stop of each of said one or more engagement grooves, each said lever is releasably engaged with a corresponding one of said locking notches of said collar.

12. The blast shield attachment system of claim 11, wherein said one or more locking notches are formed through a collar body of said collar.

13. The blast shield attachment system of claim 11, wherein said collar includes a central collar aperture formed therethrough.

14. The blast shield attachment system of claim 11, wherein said collar further comprises one or more interior flats extending into at least a portion of said central collar aperture.

15. The blast shield attachment system of claim 11, wherein a muzzle device is at least partially received within a central collar aperture.

16. The blast shield attachment system of claim 15, wherein said muzzle device attaches or couples said collar to a firearm barrel.

17. The blast shield attachment system of claim 11, wherein said collar includes one or more collar venting apertures and said blast shield includes one or more blast shield venting apertures, such that when each lever is releasably engaged with a corresponding one of said locking notches of said collar, each said collar venting aperture is aligned with at least one of said one or more blast shield venting apertures.

18. The blast shield attachment system of claim 11, wherein each engagement pin extends radially from said collar.

19. A blast shield attachment system, comprising:

a collar having one or more locking notches formed at least partially therethrough and one or more engagement pins extending therefrom; and a blast shield having a collar receiving recess, wherein one or more substantially "L" shaped engagement grooves extend from a first end of said blast shield to an engagement stop, wherein one or more levers are pivotably attached or coupled to said blast shield, such that each said lever is pivotable for releasable engagement with a corresponding one of said locking notches of said collar, and wherein when at least a portion of said collar is appropriately received within said collar receiving recess and each said engagement pin is positioned proximate said engagement stop of each of said one or more engagement grooves, each said lever is releasably engaged with a corresponding one of said locking notches of said collar.

20. The blast shield attachment system of claim 1, wherein a muzzle device is at least partially receivable within a central collar aperture to attach or couple said collar to a firearm barrel.

* * * * *